US010308332B2

(12) United States Patent
Thomas et al.

(10) Patent No.: US 10,308,332 B2
(45) Date of Patent: Jun. 4, 2019

(54) FULL FACE MASK AND SNORKEL

(71) Applicant: Datafly Commerce Inc., Draper, UT (US)

(72) Inventors: Scott Richard Thomas, Herriman, UT (US); Mark Henry Thomas, Salt Lake City, UT (US); Gerardo David Ayala, Cedar Hills, UT (US); Samuel Joseph Wellskopf, Salt Lake City, UT (US)

(73) Assignee: Datafly Commerce Inc., Draper, UT (US)

( * ) Notice: Subject to any disclaimer, the term of this patent is extended or adjusted under 35 U.S.C. 154(b) by 0 days.

(21) Appl. No.: 15/974,578

(22) Filed: May 8, 2018

(65) Prior Publication Data

US 2018/0319471 A1 Nov. 8, 2018

Related U.S. Application Data

(60) Provisional application No. 62/502,956, filed on May 8, 2017.

(51) Int. Cl.
*B63C 11/16* (2006.01)
*B63C 11/20* (2006.01)

(52) U.S. Cl.
CPC ..... *B63C 11/16* (2013.01); *B63C 11/205* (2013.01); *B63C 2011/165* (2013.01)

(58) Field of Classification Search
CPC ..... B63C 11/16; B63C 11/205
See application file for complete search history.

(56) References Cited

U.S. PATENT DOCUMENTS 2,317,237 A * 4/1943 Wilen ..... B63C 11/16 128/201.11
2,381,568 A * 8/1945 Booharin ..... A62B 18/02 128/201.15

(Continued)

FOREIGN PATENT DOCUMENTS

FR 2720050 A1 * 11/1995 ..... B63C 11/16
GB 822680 A * 10/1959 ..... B63C 11/205

(Continued)

OTHER PUBLICATIONS

PCT/US2018/031677 International Search Report and Written Opinion of the International Searching Authority, dated Jul. 24, 2018.

(Continued)

*Primary Examiner* — Kathryn E Ditmer
(74) *Attorney, Agent, or Firm* — David A. Jones; Nadesan Beck P.C.

(57) ABSTRACT

A full face mask and snorkel can include a full face mask and a rigid snorkel attached to the side of the mask. The side location of the ridged snorkel avoids peripheral ducting of air around the full face mask. The full face mask includes a main peripheral full face seal coupled to the mask's rigid support structure. The full face mask includes a separation seal dividing the full face mask into at least an upper chamber. The snorkel is affixed to the side of the full face mask at a location proximate to where the separation seal meets the main seal. A full face mask and snorkel can also include an exhalation valve located within the snorkel and proximate to the mask so as to avoid a volume of respirated air within the snorkel from being reinhaled into the lower chamber of the full face mask.

25 Claims, 20 Drawing Sheets

(56) References Cited

U.S. PATENT DOCUMENTS

| | | | | | |
|---|---|---|---|---|---|
| 2,810,386 | A * | 10/1957 | Reed | A62B 18/08 | 128/201.15 |
| 3,721,236 | A * | 3/1973 | Bardehle | B63C 11/16 | 128/201.11 |
| 4,676,236 | A * | 6/1987 | Piorkowski | A62B 18/04 | 128/200.28 |
| 5,117,817 | A * | 6/1992 | Lin | B63C 11/205 | 128/201.11 |
| 9,132,299 | B2 * | 9/2015 | Sutton | A62B 18/02 | |
| 2001/0013346 | A1 | 8/2001 | Lemke | | |
| 2005/0268906 | A1 * | 12/2005 | Mix | B63C 11/205 | 128/201.11 |
| 2008/0047552 | A1 * | 2/2008 | McCarthy | B63C 11/205 | 128/201.11 |
| 2008/0135045 | A1 * | 6/2008 | Johnson | B63C 11/205 | 128/201.11 |
| 2009/0211575 | A1 * | 8/2009 | Shiue | B63C 11/16 | 128/201.11 |
| 2013/0074835 | A1 * | 3/2013 | Newhouse | B63C 11/16 | 128/201.11 |
| 2016/0297505 | A1 * | 10/2016 | Caprice | B63C 11/16 | |

FOREIGN PATENT DOCUMENTS

| | | | | |
|---|---|---|---|---|
| GB | 2498753 | A | 7/2013 | |
| JP | 2002154480 | A * | 5/2002 | B63C 11/205 |
| WO | WO-2012044113 | A2 * | 4/2012 | A62B 18/02 |
| WO | WO-2015170013 | A1 * | 11/2015 | B63C 11/16 |
| WO | 2016170253 | A1 | 10/2016 | |

OTHER PUBLICATIONS

PCT/US2018/031677 Search History, date of search Jul. 24, 2018.

* cited by examiner

FULL FACE MASK AND SNORKEL

CROSS-REFERENCE TO RELATED APPLICATIONS

This application claims priority to and the benefit of U.S. Provisional Patent Application No. 62/502,956 filed May 8, 2017, the contents of which are hereby incorporated herein by reference for all purposes.

BACKGROUND

Snorkeling is the practice of swimming on or through a body of water while equipped with a diving mask, a shaped tube called a snorkel, and usually fins. The snorkel is a draw-type snorkel for use under water that includes means extending to the surface of the water to allow the user to draw air from the atmosphere with no means to supply respiratory gas under positive pressure as in scuba diving.

As described in the background of United State Patent Publication 20160107734, a traditional dry snorkel usually includes the following components: A. Air inlet: the user can breathe in and breathe out when the air inlet is above water while skin diving on the water surface. B. Tube: it has two parts, namely a hard tube and a soft tube. The basic length of the tube is 46-48 cm. The overlong tube may affect the discharge of carbon dioxide due to fluidic friction. The function of the soft tube is to adjust the angle of the snorkel with respect to the mouth conveniently whereby the user's mouth can feel more comfortable. C. Mouthpiece: A good-quality snorkel may set an inclined design to fit in with the mouth shape and the face so that the user's mouth feels less fatigued in the sport of skin diving. D. Discharging valve: It comprises a downward water outlet and a silicone membrane (similar to the cardiac valve of the heart) functioning as a unidirectional discharging element. It can blow part of water in the tube off via the water outlet very easily and prevent the seawater from entering the tube. E. Float valve: It is exclusive for the dry snorkel. When the air inlet of the snorkel is under the water surface, the float valve closes the air inlet to prevent the entry of seawater into the tube.

French Patent FR2720050 discloses an underwater mask and snorkel where the internal wall of the snorkel forms two tubes, and a square section tip has a valve for the discharging of air in the ferrule. A flexible joint fixes the snorkel to the mask which has a transparent plastics visor. The part fixing the snorkel to the mask has an opening joint allowing air expiration. A plastics projection directs inspired air through 180 degrees in the mask near the visor preventing formation of deposits. A flexible silicon hollow joint insulates the mask and allows expiration of air to the snorkel. Rubber fixing bands cover the ears and a part of the skull. An internal flexible silicon partition separates the mask into an upper chamber for sight and a lower chamber for breathing. There are two valves which open for air aspiration and close for expiration.

U.S. Patent Publication 2016/0297505 discloses a full face diving mask similar to FR22720050 yet addressing the drawback of the aforementioned French patent where the user over-tightens the mask attaching system, causing the hollow flexible seal incorporating the ducts to be squeezed against the face which will cause obstruction of the channel through which exhaled air flows 180 degrees around the sides of the user's face and into the exhaust channel of the snorkel disposed at the temple of the user. On the other hand, if the user does not sufficiently tighten the attaching system there will no longer be a perfect seal between the face and skirt failing which there is a risk that water might enter inside the lower or upper chambers, this being another undesirable problem.

The designs of FR22720050 and US2016/0297505 suffer from several inherent drawbacks discussed in further detail below. For example, both designs require that the exhaled respirated air flow 180 degrees around the sides of the user's face before reaching the exhalation chamber of the mask. This constriction of the exhaled air requires an increase in work in breath by the snorkeler. Moreover, the placement and design of the snorkel itself is prone to being inadvertently submerged. In addition, the internal flow of the inhaled surface air is restricted as it flows over the optical lens of the mask.

According to the various embodiments and improvements discussed hereinafter new and innovative full-face mask and snorkel designs and processes associated thereto are disclosed and set forth in the claims. The subject matter claimed herein is not limited to embodiments that solve any disadvantages or that operate only in environments such as those described above. Rather, this background is only provided to illustrate examples of the technology area where some embodiments described herein may be practiced and find certain advantages.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Embodiments disclosed herein relate to respiratory devices as well as methods of design and manufacture thereof. The respiratory device can be used during exploration of aquatic environments. The respiratory device includes a full face mask and snorkel with improved structures, designs and air flow. The improved air flow can be a result of reduced exhalation ducting. The improved air flow can result in reduced work of breath (WOB). WOB has been simulated and measured by the Applicant and results in a reduction in WOB by up to 91% over other available full face masks such as those discussed in the Background. This improvement in the reduction of WOB was accomplished by the inventors of this patent application at least in part by moving the snorkel to the side where the snorkel may directly span the separation seal of the mask and directly access the optical intake chamber and the lower respiratory exhalation chamber. Moreover, this decrease in WOB is provided by having a more direct path for the air to flow into the breathing chamber along with opening up the breathing ports and the unique shape of the side snorkel.

Other improvements in the angular expanse of the undistorted viewing area can be improved according to the illustrated embodiments. As disclosed herein a multi-angled snorkel extending from the side of the frame of a full-face snorkel provides improved extension above the water level when in use. The frame of the mask can comprise an exhaust port from a lower respiration chamber directly to the snorkel without peripheral ducting required by the 180 degree ducting of the previously discussed prior art designs. Rather, in such embodiments 0 degrees of ducting around the sides of the user's face are provided for direct access to the snorkel before reaching the exhalation chamber of the mask. The lack of ducting around the periphery of the mask reduces fluidic friction therein and allows for a larger exhalation portion from the lower respiration chamber as opposed to the prior art previously discussed. The size of the exhalation channel can be increased as the exterior ducting is removed. As such, the overall ducting diameter may be increased by 20% or even doubled. In addition the fluidic friction caused by exhaling through peripheral ducting is reduced or eliminated.

The location of the snorkel to the mask is on the side of the mask which is in direct contrast to the upper location of the prior art references previously discussed. The side location of the snorkel attached directly to the side of the mask is proximate to the interface between a peripheral seal and a separation seal providing various advantages over the prior art. Thus, the location of the snorkel can be considered to span this seal interface surrounding the face of the snorkeler and spanning the divide between the upper optical zone of the mask where the snorkeler's eyes are covered by the lens of the mask from the lower respiration zone where the snorkeler's mouth and nose are covered by the mask. Thus, the mask does not require any ducting to or from the snorkel, rather only a direct inlet and direct outlet port thereto. As a result, the exhalation port may have greater exhalation fluidic volume, even twice or more fluidic flow capacity, providing for increased ease of exhalation of respirated gas to the surface air during use.

According to some embodiments, the snorkel can further include an improved exhalation air valve located at a position of the snorkel proximate to the mask as opposed to a position of the snorkel distal to the mask. The location of this exhalation valve can reduce a likelihood of amount of respirated air being drawing into the respiration of chamber of the mask during inhalation. For example, the volume of respirated air held by the snorkel is reduced where the expiration valve is located proximate to the mask as opposed to being located distal to the mask. According to other embodiments, an exhalation air valve can be located at the distal end or excluded. However, the advantages of the exhalation valve can provide improvements in avoiding the re-respiration of respirated air or air with a reduced level of oxygen.

The mask can include improve circulation of inhaled "fresh" air over the lens thereof. The circulation of the surface air drawn into the mask during inhalation under negative pressure created thereby circulates in a side-to-side manner over the lens of the mask as it is drawn into the upper chamber of the mask and through the separation seal into the lower respiration chamber of the mask. This side-to-side circulation of air is unique compared to the prior art where the air drawn into the mask enters from the top of the mask and circulates vertically through the separation seal as opposed to horizontally according to various teachings disclosed herein.

The full face mask includes a rigid mask support structure defining a shape of the full face mask. The full face mask is defined by an upper top side, lower bottom side, left side, and right side. The reference to the right and left side can be from the perspective of a snorkeler wearing the respiratory device. The reference to the right and left side of the full face mask to which teachings are made can be reversible in that the placement of a feature on the right side of the full face mask can make similar reference to the interchangeable teachings on the left side of the full face mask, and vice versa.

The full face mask includes a main full face peripheral seal coupled to the mask's rigid support structure. The full face seal can be made of a flexible resilient material for creating a seal between the full face mask and a face of a user when worn by the user. The full face mask can further include a separation seal dividing the full face mask into at least an upper chamber sealed from a lower chamber by the separation seal. The upper chamber can encapsulate the eyes of the snorkeler and the lower chamber can encapsulate the nose and mouth of the snorkeler. The snorkel providing surface air access to the upper chamber via an intake channel of the snorkel and the snorkel providing surface air access to the lower chamber via an exhaust channel of the snorkel.

The full face mask and snorkel further includes a rigid snorkel affixed to a side of the full face mask. The full face mask and snorkel can include only a single rigid snorkel affixed to only a single side of the full face mask. The rigid snorkel can be rigidly connected to the full face mask or formed integral with the full face mask. And in some embodiments, the connection point of the snorkel to the side of the full face mask spans a midpoint on the side of the mask to which the snorkel is attached between the top and bottom of the full face mask. The location on the side of the full face mask where the snorkel is attached can also span the location where the separation seal meets the main seal of the mask defining an edge point where the separation between the upper and lower zones of the mask meet. At this union point between the main seal and the separation seal, aspiration and expiration ports are disposed for relatively close, or the relatively closest, adjacent access to the first and second zones for aspiration and expiration of air respectively.

The rigid snorkel includes an air intake channel extending along a length of the rigid snorkel for intake of surface air into the upper chamber of the full face mask. The rigid snorkel can further include an exhaust channel extending along a length of the rigid snorkel for exhaust of respirated air from the lower chamber of the full face mask. The mask can be devoid of exhaust channels defined around a periphery of the mask or frame. Thus, the mask may be referred to as being "duct-less" as devoid of peripheral ducts. Rather, the mask has direct ports between the upper and lower chambers directly to the snorkel due to the unique positioning of the snorkel to the side of the mask as opposed to the prior art previously discussed.

The rigid support structure of the full face mask can include an integrated port disposed on a side of the rigid support structure for connection to the snorkel. The integrated port of the rigid support structure of the mask includes a direct inlet for surface air from the intake channel of the snorkel to the upper chamber of the full face mask and a direct outlet for respirated air from the lower chamber of the mask to the exhaust channel of the snorkel.

The full face mask and snorkel can further include a circulatory valve providing circulation of intake air from the upper chamber to the lower chamber and inhibiting circulation of respirated air from the lower chamber to the upper chamber. Thus, the circulatory valve can be considered a one way valve in that the air is circulated there through from the upper chamber to the lower chamber but obstructs circulation from the lower chamber to the upper chamber. One or more circulation valves can be disposed on a side of the full face mask opposite to a side of the full face mask to which the snorkel is affixed. And, the full face mask can be devoid of circulation between the upper and lower chamber on a side of the full face mask to which the snorkel is affixed or multiple circulation valves may be provided on both sides of the separation seal so as to increase circulation from the upper chamber to the lower chamber but obstruct circulation from the lower chamber to the upper chamber. For example, if the snorkel is affixed to the right side of the full face mask the circulatory valve can be deposed on to the left of a nose portion of the separation seal of the full face mask. And, if the snorkel is disposed on the left side of the mask circulation valve between the upper and lower zones of the mask can be disposed only on the right side of the nose piece of the separation seal of the mask. As such, the arrangement of the snorkel and circulation valve promotes side-to-side circulation of intake air in the upper chamber and over an inner surface of a clear optical lens of the full face mask to reduce fogging and condensation thereon.

The side mount location of the snorkel can allow for more direct access of the snorkel to the upper and lower chambers of the mask. The direct access of the snorkel to the upper and lower chambers of the mask promotes a reduced distance of exhaust air channel length to surface air. Reduction in exhaust air channel length reduces fluidic friction during exhaust of respirated air thereby lowering the positive pressure of exhalation required to exhaust the respirated air by a snorkeler.

The full face mask of the respiration device avoids adjustment of the angle of the snorkel with respect to the user's mouth and the side mounted snorkel provides direct exhaust of respirated air by the user to the snorkel. The rigid snorkel can be formed integral with the rigid support structure of the full face mask or rigidly connected thereto. The separation seal divides the full face mask in to the upper optical zone proximate the top portion of the full face mask and the lower respiratory zone proximate the bottom portion of the full face mask. And, the upper zone includes a transparent lens covering the eyes of the user when worn by the user creating an underwater air encapsulated zone for the user to view the underwater aquatic environment. The lower zone creates an under-water air encapsulated respiratory air supply for the user to breathe surface air.

The angled snorkel allows for much more movement in the water and prevents the snorkel valve from closing off prematurely due to inadvertent submersion. With the straight snorkel that comes off the top of the mask shown and described in the aforementioned prior art the range of movement is limited. For example, if a user tilts their head down too much water will enter into the snorkel causing the float to block the air momentary. With the angled snorkel design disclosed herein according to the present invention such limited range of movement is avoided therefore providing an improved snorkeling experience. The snorkel can be designed, manufactured, or provided with a multi angular design. The snorkel can extend from the frame of the mask at a first acute angle then extend at a second acute angle relative to the mask. The second angle may be close to 90 degrees or between an acute angle of 70 and an obtuse angle of 100 degrees relative to the frame of the mask whereas the prior art previously discussed may be of a reduced acute angle extending in a single linear direction.

The first channel of the snorkel supplies surface air to a first zone of the full face mask, the first zone of the full face mask surrounding the eyes of the user when worn by the user. A second channel of the snorkel provides a respiratory exhaust air conduit to the surface air. The separation seal extends between the first and second zones of the full face mask and includes a separation seal valve. The separation seal valve allows air to pass through the separation seal under negative pressure in the second zone of the full face mask but occluding air from passing through the separation seal under positive pressure in the second zone of the full face mask. The negative pressure in the second zone of the full face mask is created during inhalation by the user and the positive pressure in the full face mask is created during exhalation by the user.

The snorkel is attached to the side of the mask proximate to where the separation seal meets a periphery of the mask. The rigid support structure defining a shape of the full face mask surrounds the eyes, nose, and mouth of the wearer. According to various embodiments, the flat portion of the lens of the snorkel extends below the location of the nose so as to provide increased visibility. Often a curved or angled viewing section of the lens of the snorkel distorts the viewable area. As such, the inventors of this patent application have found that by increasing the flat viewable area of the lens of the snorkel surrounding the nose or bridge portion of the separation seal increases the viewable area to a greater area as compared to the prior art.

According to several embodiments, an intake air diverter may be disposed at the location at which the intake air enters the upper optical chamber of the snorkel. The intake air diverter can include an appendage which directs the air over the internal surface of the lens when drawn into the mask from the surface air.

According to additional improvements in the design of the full face seal the chin portion of the full face seal may be extended over the lower portion of a user's chin. This increased chin length of the full face seal has been found to decrease the likelihood of leaking and finds particular improvements for users having facial hair. The length of the full face seal over the chin may be increased by 15 or even 30 percent as compared to the prior art previously discussed and extends below the chin up to one inch for example.

A release button disposed on the snorkel for disconnecting the snorkel from the frame may be enlarged according to various teachings disclosed herein. The enlarged button may result in ease of access thereto and may be particularly advantageous for users having large hands or wearing insulated gloves.

A snorkel is disclosed with a float valve that avoids inadvertent sealing due to inhalation. The snorkel includes an air intake channel extending along a length of the rigid snorkel for intake of surface air and an exhaust channel extending along a length of the rigid snorkel for exhaust of respirated air. The snorkel includes a float valve including a float, a float seal, a float channel having a proximate end proximate the float seal. The float channel having a distal end away from the float seal and a float chamber sized and shaped to partially encapsulate the float, the float chamber preventing or reducing flow of inhaled air over the float during surface snorkeling. The float chamber may further include an aperture allowing water to enter the float chamber during submersion.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Figure 1:
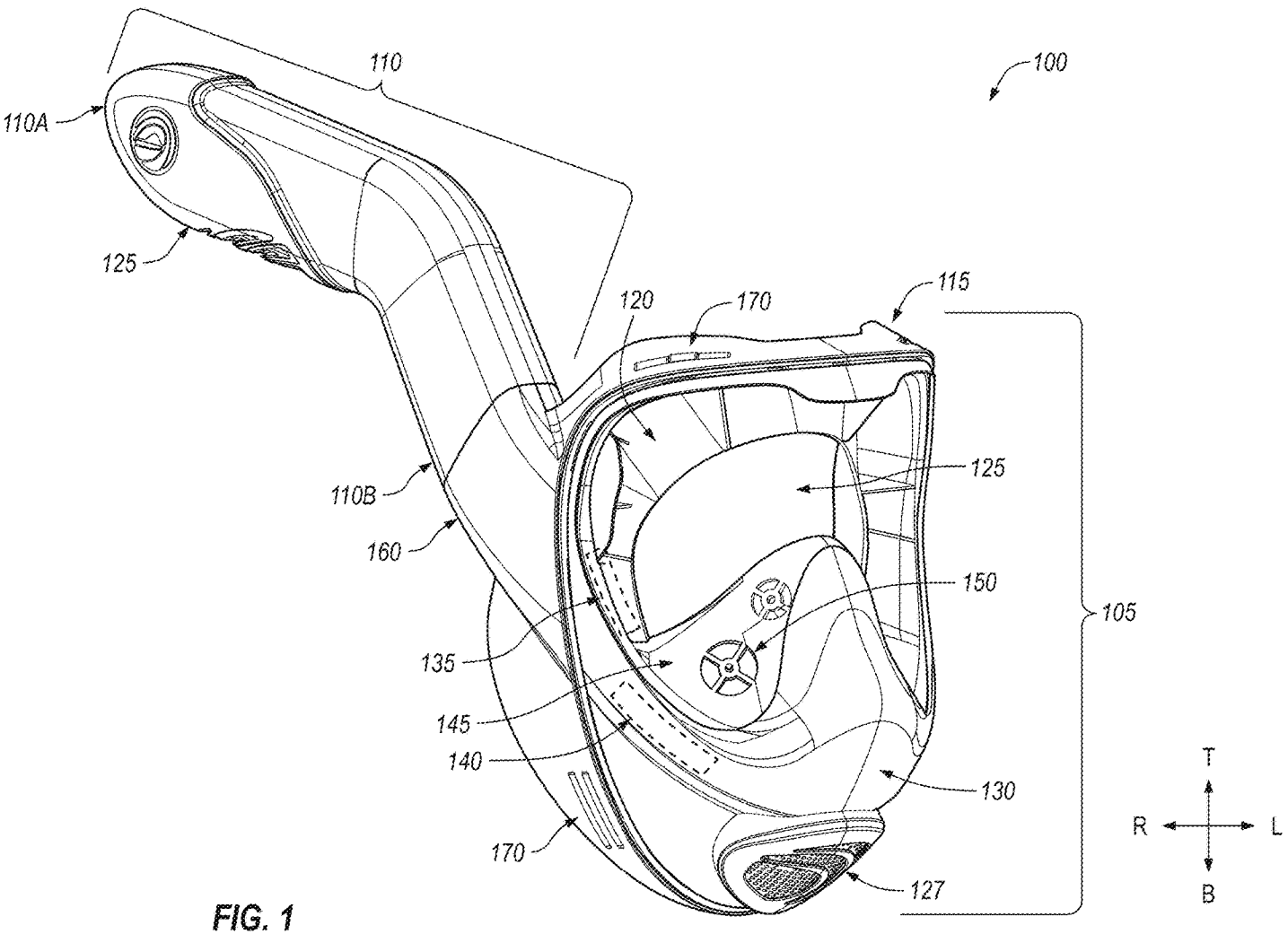
FIG. 1 illustrates a full face mask and snorkel for use during exploration of aquatic environments.

The following embodiments illustrate full face mask and snorkels, designs thereof, and methods associated therewith. Certain embodiments disclose improvements in full-face mask and snorkel designs where functional and design improvements can be realized using a substantially rigid side-mounted snorkel to a full face mask. The embodiments can eliminate the 180 degree peripheral ducting previously employed in the design of full face snorkel masks. Certain embodiments further find improvements in air circulation within the snorkel and mask as well as simplification of design while realizing functional improvements thereto. Various embodiments can include an expiration valve disposed in a location of the snorkel proximate to the mask as opposed to a location distal to the mask. Various embodiments include improved expiration of respirated air due to reduced fluidic friction as a result of the unique design configurations. In fact, fluidic flow volume may be increased by 50%, 100%, or more by use of direct ports between the upper and lower chambers of the mask to the snorkel as opposed to peripheral ducting previously employed. The distance of air flow travel from the lower respiratory chamber to the surface air may also be reduced.

The angles and design of the snorkel relative to the mask and location on the side of the mask also allows for much more movement in the water and prevents the snorkel valve from closing off prematurely due to inadvertent submersion. With the straight snorkel that comes off the top of the mask shown and described in the aforementioned prior art the range of movement is limited. For example, if a user tilts their head down too much water will enter into the snorkel causing the float to block the air momentary. With the angled snorkel design disclosed herein according to the present invention such limited range of movement is avoided therefore providing an improved snorkeling experience.

The subject matter relates to the supply of breathable gas to and from a living human body without the use of a tube, mouthpiece, or other channel being inserted into the mouth of the user while snorkeling. Thus, flexible alignment of the mouthpiece is not required. Rather, such designs include a full face sealed mask for passing surface air through a body of water while snorkeling. Similarly, such designs include use of the full face sealed mask for passing respirated air through the body of liquid during exhalation. The full face mask can create a seal around a snorkeler's eyes, nose, and mouth. The seal can be created using a main seal that substantially isolates water from entering the mask when worn by the snorkeler. According to various embodiments disclosed hereinafter, the mask and snorkel can define a closed-loop respiration passageway. This closed loop respiration passageway can include a first inhalation channel and a second exhalation channel in the snorkel. The inhalation channel can include an inhalation channel of the snorkel that is separate from an exhalation channel of the snorkel. The inhalation channel of the snorkel can be in direct gaseous communication to an inhalation port of the mask. The inhalation port of the mask is disposed in a first upper optical zone of the mask. The exhalation channel of the snorkel can be in direct gaseous communication to an exhalation port of the mask. The exhalation port of the mask is disposed in a second lower respiration zone of the mask. The first upper optical zone of the mask and second lower respiratory zone of the mask being separated by a separation seal of the mask. The separation seal of the mask creating a sealed gaseous separation barrier extending over the cheeks and nose bridge of the snorkeler when worn. This separation seal laterally extends from opposing sides of the main facial seal of the mask. The separation seal can include a one-way valve allowing for surface air to be drawn from the inhalation channel into the first zone and through the one way valve to the second lower zone during inhalation. During exhalation, however, the one way valve impedes air from flowing from the second zone to the first zone thereby causing expiration of the respirated air into the exhalation port of the mask and to the exhalation channel of the snorkel and to the surface air.

Thus, according to various embodiments, the exhaled air can be less likely to be re-inhaled. This improved use of "fresh air" according to various embodiments disclosed herein can avoid what can be referred to as breathing "dead air" that composes a higher percentage of previously exhausted respiratory air. Previously exhausted respiratory air can be less "fresh" taste or have a lower oxygen content as compared to air that is more recently drawn directly from the surface air. According to various embodiments, the re-respiration of respirated air is reduced. In some embodiments, an exhalation valve can be provided so as to allow air to be exhausted to surface air but substantially inhibit or reduce the amount of respirated air that is drawn into the mask during inhalation. In some embodiments, a one-way exhalation valve is provided in the exhalation channel of the snorkel. The exhalation valve may be disposed proximate to the mask or at a distal end of the exhaust channel of the snorkel. As such, the inhalation of "dead" air having a reduced amount of oxygen due to respiration is reduced.

Various embodiments disclose a full face mask and snorkel having the two isolated zones. As previously discussed, the first zone can be isolated from the second zone via a separation seal. The first zone can include an air encapsulated optical zone enclosing the user's eyes when worn. The second zone can include an air encapsulated respiratory zone enclosing the user's mouth and nose when worn. The separation seal can include the valve structure. The valve structure can be disposed between the first and second zones. The valve structure can include a one-way air valve including a flexible diaphragm. And, the flexible diaphragm can allow gas to move from the first zone to the second zone during inhalation but substantially obstruct gas from moving between the second zone to the first zone during exhalation.

The separation seal can extend over a relatively central portion of a snorkeler's face and include a nose seal portion that extends over a bridge of the snorkeler's nose. The separation seal can extend over the nose of the snorkeler as well as over opposing right and left cheeks of the snorkeler. The portions extending over the cheeks of the snorkeler can be described as cheek seals. Thus the separation seal can include the nose seal and two cheek seals on opposing sides of the nose seal. The cheek seals extending from the nose seal to the main seal disposed around a periphery of the mask. The main seal creating a water-tight seal between the interior of the mask and the exterior aquatic environment during exploration of the aquatic environment by the snorkeler. And, the valved separation seal creating a selectably occluding gaseous partition between the upper and lower zones of the mask.

The full face mask and snorkel include draw-type snorkel. The snorkel can be designed to extend partially under water and extending to the surface of the water to allow the user to draw air from the atmosphere without means to supply respiratory gas under positive pressure. Rather, the surface air is drawn into the snorkel under negative pressure during inhalation by the snorkeler and expelled from the snorkel under positive pressure created by exhalation by the snorkeler.

According to the embodiments disclosed herein the support frame structure of the mask can be integral to the rigid structure of the snorkel. Thus, the snorkel and frame structure of the mask can be rigidly connected to one another, or formed integral to one another according to various embodiments. Thus the location where the snorkel and frame structure meet can include a junction, connection, seam, or be seamless and formed integral to one another. Moreover, one or more air passageways of the snorkel portion can extend into, or align with, the structure of the mask. As such, the snorkel and mask can be referred to as an integrated underwater full face mask and snorkel. The integrated underwater full face mask and snorkel can be designed such that the mask portion defines a closed air-filled pocket of breathable air for the user to access while the breathable channel(s) of the mask extend into the snorkel having a proximate end exposed to surface air.

According to various embodiments disclosed herein the air passage from the mask to the snorkel is disposed immediately adjacent to an edge of the mask. In certain embodiments finding particular advantages, the air passage from the mask to the snorkel is disposed adjacent to a side of the mask where the separation seal meets the main seal of the mask there by defining a distinct location of division between the first upper optical zone and the second lower respiration zone of the mask. The connection between the snorkel and mask can span this connection location between the separation seal and the main seal of the mask. Thus, the connection interface location between the snorkel and mask can include a portion of the upper zone immediately adjacent to a portion of the lower zone of the mask. Thus, the snorkel is capable of having more direct immediate access to both the upper and lower zones of the mask due to being disposed on the side of the mask. Moreover, the inhalation port and exhalation port of the opposing zones of the mask more directly access the channels of the snorkel, and as a result the surface air, because the snorkel and both of its distinct channels are disposed on the side of the mask as opposed to being disposed on the top the mask as previously discussed. Due to this side-mounted snorkel, improved lateral circulation of surface air over the optical lens of the mask can be obtained by placing the circulation valve of the separation seal distal from the side to which the snorkel is disposed on the mask. As such, the surface air finds unique and improved circulation over the interior of the optical lens of the mask thereby further reducing internal fogging and condensation to the optical lens and visual distortion of the aquatic view during snorkeling.

The improved air flow can be a result of reduced exhalation ducting causing increased fluidic friction. The improved air flow can result in reduced work of breath (WOB). WOB has been simulated and measured by the Applicant and results in a reduction in WOB by up to 91% over other full face masks such as those discussed in the Background.

The Applicant provided several masks similar to those discussed in the Background section along with the mask as shown and disclosed herein to a company that specializes in testing scuba diving equipment. Embodiments disclosed herein performed by far the best as having vastly reduced airway restriction measured as WOB. WOB for the applicant's inventive design was 0.73 Joules per liter (J/l) in the test taken under controlled conditions. J/l is a measurement of energy in the exhale and inhalation work combined (inhale work plus exhale work=WOB), which correlates with how much effort is required to breathe through the mask at a certain flow rate. The same tests were conducted with multiple commercially available masks such as those discussed in the Background section. The prior art masks ranged from 1.22 to 1.40 WOB (J/l) in such tests. Thus, the applicant's inventive design disclosed in this application reduced the WOB by up to 91% when compared to other available full face masks. While some might argue that inhale work of breathing is more important to the user experience than exhale work of breathing, where the lower the inhale number the easier it is to draw in fresh air. The mask according to the teachings herein improved both inhalation and exhalation over all the masks tested in both categories including inhalation as well. This improvement is important because less energy is required to breathe resulting in a much more enjoyable experience for the user.

For example, the table below shows the performance test results for conventional snorkel such as the previously discussed in the Background section of this patent application where the mean WOB was 1.22 (J/l).

| Equipment Performance | | | |
|---|---|---|---|
| ANSTI | Dive Lab | ANSTI | |
| Certificate Reference | LSTF-0615-20180327_133011 | | |
| Date: Mar. 27, 2018 | | Time: 1:30:11 PM | |
| Equipment | | | |
| Regulator Type | PRE-TEST SNORKLE FFM TESTING | | |
| Serial Number | | | |
| Interstage Pressure Static | 0.0 psi | | |
| | Mean | Min | Max |
| Conditions of Test | | | |
| Room Temperature (F.) | 77.0 | | |
| Exhale Temp (F.) | 72.5 | 72.2 | 72.7 |
| Water Temp (F.) | 69.3 | 69.3 | 69.4 |
| Humidity (% RH) | 100.2 | 100.1 | 100.2 |
| HP Supply Pressure (psi) | 0.4 | −3.3 | 4.1 |
| Tidal Volume (litre) | 2.50 | 2.50 | 2.50 |
| Breath Rate (bpm) | 25.10 | 24.72 | 25.34 |
| Ventilation Rate (lpm) | 62.75 | 61.79 | 63.34 |
| Results (3 Loops, SA: 50) | | | |
| Inhale Pressure (mbar) | 10.93 | 10.72 | 11.07 |
| Inhale Pos Pressure (mbar) | 0.02 | 0.01 | 0.03 |
| Exhale Pressure (mbar) | 7.11 | 7.07 | 7.19 |
| Ext Work of Breathing (J/l) | 1.22 | 1.21 | 1.23 |
| Inhale Work (J/l) | 0.74 | 0.73 | 0.75 |
| Pos Inhale Work (J/l) | 0.00 | 0.00 | 0.00 |
| Exhale Work (J/l) | 0.48 | 0.48 | 0.49 |

The table below shows the performance test results of a second conventional prior art snorkel such as previously discussed in the Background section of this patent application where the mean WOB was 1.21 (J/l).

| Equipment Performance | | | |
|---|---|---|---|
| ANSTI | Dive Lab | ANSTI | |
| Certificate Reference | LSTF-0615-20180327_131342 | | |
| Date: Mar. 27, 2018 | | Time: 1:13:42 PM | |
| Equipment | | | |
| Regulator Type | PRE-TEST SNORKLE FFM TESTING | | |
| Serial Number | | | |
| Interstage Pressure Static | 0.0 psi | | |
| | Mean | Min | |
| Conditions of Test | | | |
| Room Temperature (F.) | 77.0 | | |
| Exhale Temp (F.) | 70.3 | 69.8 | 70.8 |
| Water Temp (F.) | 69.8 | 69.8 | 69.8 |
| Humidity (% RH) | 100.2 | 100.1 | 100.2 |
| HP Supply Pressure (psi) | 0.1 | −2.5 | 2.6 |
| Tidal Volume (litre) | 2.50 | 2.50 | 2.50 |
| Breath Rate (bpm) | 25.06 | 24.86 | 25.38 |
| Ventilation Rate (lpm) | 62.62 | 62.07 | 63.47 |
| Results (3 Loops, SA: 50) | | | |
| Inhale Pressure (mbar) | 9.60 | 9.52 | 9.71 |
| Inhale Pos Pressure (mbar) | 0.05 | 0.04 | 0.07 |
| Exhale Pressure (mbar) | 7.62 | 7.59 | 7.66 |
| Ext Work of Breathing (J/l) | 1.21 | 1.20 | 1.22 |
| Inhale Work (J/l) | 0.68 | 0.68 | 0.69 |

-continued

| Equipment Performance | | | |
|---|---|---|---|
| Pos Inhale Work (J/l) | 0.00 | 0.00 | 0.00 |
| Exhale Work (J/l) | 0.53 | 0.52 | 0.53 |

And, the table below shows the performance test results of the currently disclosed innovative snorkel design with such marked improvements shown therein having a greatly improved mean WOB of 0.73 (J/l).

| Equipment Performance | | | |
|---|---|---|---|
| ANSTI | Dive Lab | ANSTI | |
| Certificate Reference | LSTF-0615-20180327_140420 | | |
| Date: Mar. 27, 2018 | | Time: 2:04:20 PM | |
| Equipment | | | |
| Regulator Type | PRE-TEST SNORKLE FFM TESTING | | |
| Serial Number | | | |
| Interstage Pressure Static | 0.0 psi | | |
| | Mean | Min | Max |
| Conditions of Test | | | |
| Room Temperature (F.) | 77.0 | | |
| Exhale Temp (F.) | 74.4 | 74.3 | 74.5 |
| Water Temp (F.) | 71.7 | 71.6 | 71.7 |
| Humidity (% RH) | 100.2 | 100.1 | 100.2 |
| HP Supply Pressure (psi) | 0.5 | −3.7 | 4.3 |
| Tidal Volume (litre) | 2.50 | 2.50 | 2.50 |
| Breath Rate (bpm) | 24.91 | 24.78 | 25.06 |
| Ventilation Rate (lpm) | 62.27 | 61.93 | 62.68 |
| Results (3 Loops, SA: 50) | | | |
| Inhale Pressure (mbar) | 5.05 | 5.01 | 5.13 |
| Inhale Pos Pressure (mbar) | 0.03 | 0.00 | 0.07 |
| Exhale Pressure (mbar) | 5.71 | 5.62 | 5.78 |
| Ext Work of Breathing (J/l) | 0.73 | 0.72 | 0.74 |
| Inhale Work (J/l) | 0.35 | 0.35 | 0.35 |
| Pos Inhale Work (J/l) | 0.00 | 0.00 | 0.00 |
| Exhale Work (J/l) | 0.38 | 0.38 | 0.39 |

This improvement in snorkel design resulting in the reduction of WOB was accomplished by the inventors of this patent application by moving the snorkel to the side of the mask where it may directly span the separation seal of the mask and directly access the optical intake chamber and the lower respiratory exhalation chamber. Moreover, this decrease in WOB is provided by having a more direct path for the air to flow into the breathing chamber along with opening up the breathing ports and the unique shape of the side snorkel. Additional improvements and advantages are discussed hereinafter and would be apparent to one of ordinary skill in the snorkeling art in view of such disclosure.

FIG. 1 illustrates a combination full face mask and snorkel 100 for use during exploration of aquatic environments. The full face mask and snorkel 100 includes the components of a full face mask 105 and snorkel 110. The full face mask 105 includes a rigid mask support structure 115. The rigid mask support structure 115 defines a shape of the full face mask 105 and can include multiple subcomponents for an assembled full face mask 105. The full face mask 105 is defined by the directions top (T), bottom (B), left (L), and right (R) from the perspective of a person wearing full face mask and snorkel 100 as shown in FIG. 1. The full face mask 105 includes a main full face seal 120 coupled to the mask's 105 rigid support structure 115. The main full face seal 120 is made of a flexible resilient material for creating a seal between the full face mask 105 and the face of a person wearing the full face mask and snorkel 100.

The snorkel 110 can be defined as having a distal end 110A and a proximate end 110B, the distal end 110A being more distant from the full face mask 105 as opposed to the proximate end 110B being closer to the full face mask 105. The proximate end 110B of the snorkel 110 can be connectable to the full face mask 105 or made integral therewith. And, the distal end 110A of the snorkel 110 is selectively open by a float valve for accessing surface air and allowing for the surface air to be drawn into the distal end 110A of the snorkel 110.

With cross-reference to FIGS. 1, 2A, 2B, and 2C the distal end 110A of the snorkel 110 includes a float 122 and float channel 123 covered by a perforated float valve cover 125 so as to allow surface air to enter the distal end 110A of the snorkel 110 and respirated air to be expelled from the distal end 110A of the snorkel 110 through the perforated cover 125. The snorkel 110 can be described as having an elongate shaft between the distal end 110A and the proximate end 110B within which two air channels 112 and 113 are disposed. The air channels include a first intake channel 112 for intake of surface air under negative pressure during inhalation and a second channel 113 for exhaust of respirated air under positive pressure created by exhalation by the person wearing the full face mask and snorkel 100. Thus the first channel 112 of the snorkel 110 can be referred to as an intake, aspiration, or inhalation channel and the second channel 113 of the snorkel 110 can be described as an exhaust, expiration, or exhalation of respirated air channel. Circulation of the intake air through the first channel 112 and second channel 113 of the snorkel 110 and through the full face mask is illustrated by arrows 112 and 113 illustrating intake surface air flow and exhaust respirated air flow respectively in FIG. 2B.

In some embodiments, the circulation of surface air into the distal end 110A of snorkel 110 and out of the distal end 110A of snorkel 110 can be referred to as closed loop. Closed loop circulation of air can refer to instances where a first channel 112 of the snorkel 110 receives air flow into the snorkel 110 and a second channel 113 of the snorkel 110 exhausts the inhaled air from the snorkel 110 after respiration by the snorkeler referred to herein as respirated air. The distance of exhaled air traveled to the surface through the mask 105 and snorkel 110 can be between 7 to 10 inches whereas the prior art distance is approximately 15 inches according to the embodiments disclosed above. Therefore, the distance from the port 140 to the surface vent can be reduced below 15 inches or preferably less than 10 inches according to several advantageous designs.

The full face mask 105 can further include a drain valve (e.g. see 403 in FIG. 4A) and drain valve cover 127 for purging the mask 105 of water by rapid exhalation as is known in the art. However, during normal inhalation and exhalation of the surface air the full face mask and snorkel 100 can otherwise operate in a closed loop through the intake channel 112 and exhaust channel 113 as previously discussed.

The full face mask 105 includes a first upper optical zone 125 and a second lower respiratory zone 130, the first zone 125 can be considered to have a first unobstructed intake port 135 with direct access to the first channel 112 of the snorkel 110. The second lower respiratory zone 130 of the full face mask 105 includes a second unobstructed exhaust port 140 with direct access to the second channel 113 of the snorkel 110. The full face mask 105 includes straps (not shown) connected to the full face mask 105 by strap connectors 170 disposed about a periphery of the full face mask 105 so as to hold the full face mask 105 securely against the face of a snorkeler during exploration of the aquatic environments.

An airtight seal between the first and second zone and the snorkeler's face and spanning the bridge of the snorkeler's nose is created by the separation seal 145 and air circulation between the first zone 125 and the second zone 130 is regulated by one or more separation seal valves 150 in this example up to four seal valves 150 as shown. The separation seal valves 150 can be disposed on one or both sides of a nosepiece of the separation seal 145 and may include two separation seal valves 150 disposed on each side of the nosepiece of the separation seal 145 so as to provide increased one-way fluidic flow of inhaled air from the first optical zone 125 to the second respiratory zone 130.

According to certain embodiments, a separation seal valve 150 may be disposed only on a side of the separation seal 145 that is opposite, or distal to, the intake port 135. In such embodiments, in addition to embodiments with circulation seals 145 disposed on both sides of the separation seal 145, this configuration promotes increased lateral circulation of fresh surface air over a lens 155 enclosing the upper optical zone 125 of the full face mask 105 so as to reduce condensation and fogging thereon. In each embodiment, the lateral horizontal flow of inhaled air over the lens 155 is different and improved as compared to the less dispersed vertical flow of air according to the prior art previously discussed in the Background.

Figures 2A, 2B:
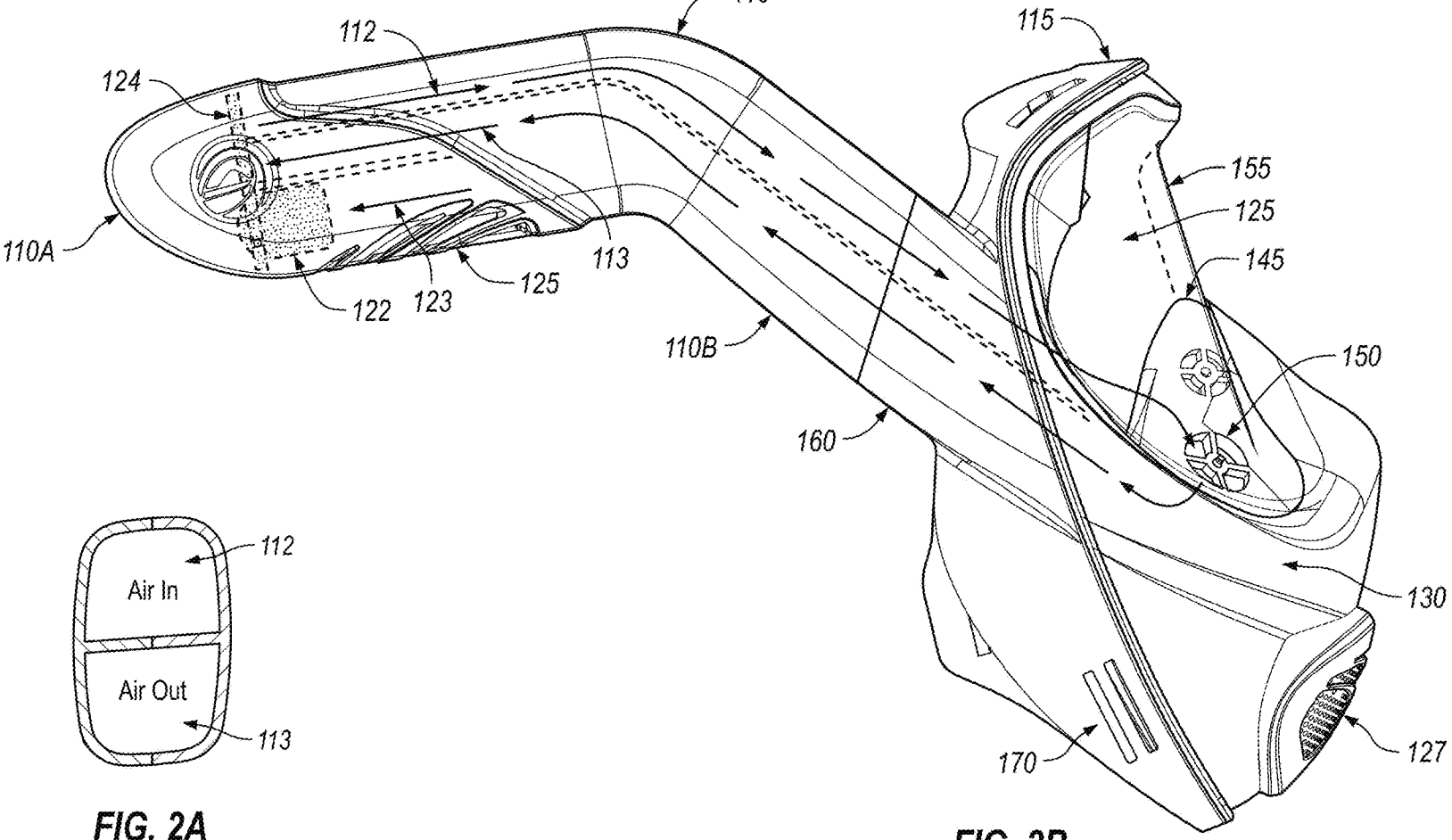
FIGS. 2A, 2B, and 2C illustrate the circulation of air through internal channels of the snorkel and full face mask of the full face mask and snorkel including means for introducing side-to-side horizontal circulation of fresh surface air over an internal lens surface of the full face mask.

In some methods and designs disclosed herein, the air circulation can be understood with reference to circulation of air between the mask 105, snorkel 110, surface air, exhaust air, and respiratory orifices (i.e. the nose and mouth) of the user. As illustrated in FIG. 2B, the nose and mouth of the user are contained in the second lower zone 130 of the mask 105 creating an air tight pocket of breathable air for the user. And, the eyes of the user are contained in the first upper zone 125 of the mask 105. Thus, the second lower respiratory zone 130 creates a breathable air pocket defined by the main seal 115 and the separation seal 145 separating the respiratory zone 130 from the optical zone 125.

With continued cross reference FIGS. 1, 2A, and 2B, the second zone 130 can have unobstructed air passage to the second port 140 of the mask 105. The second port 140 is in direct gaseous communication with the second exhaust channel 113 of the snorkel 110. Thus, the nose and mouth of the user contained in the second zone 130 of the mask 105 allows for unobstructed air passage to the second channel 113 of the snorkel 110. Similarly, the first zone 125 can have unobstructed air passage from the first port 135 of the mask 105 in direct gaseous communication with the first channel 112 of the snorkel 110. However, the first zone 125 is separated from the second zone 130 by the separation seal 145. The separation seal valve 150 selectively allows air to flow from the first zone 125 to the second zone 130 during inhalation but obstructs circulation from the second zone 130 to the first zone 125 during exhalation. The first zone 125 includes unobstructed circulation from the first channel 112 of the snorkel 110 via the first port 135 of the mask 105. The second zone 130 includes unobstructed circulation to the second channel 113 of the snorkel 110 via the second port 140 of the mask 105. As a result, the circulation of the first channel of the snorkel 110 with the second channel of the snorkel 110 is obstructed by the separation seal valve 150 during exhalation by the user but unobstructed during inhalation by the user.

Figure 2C:
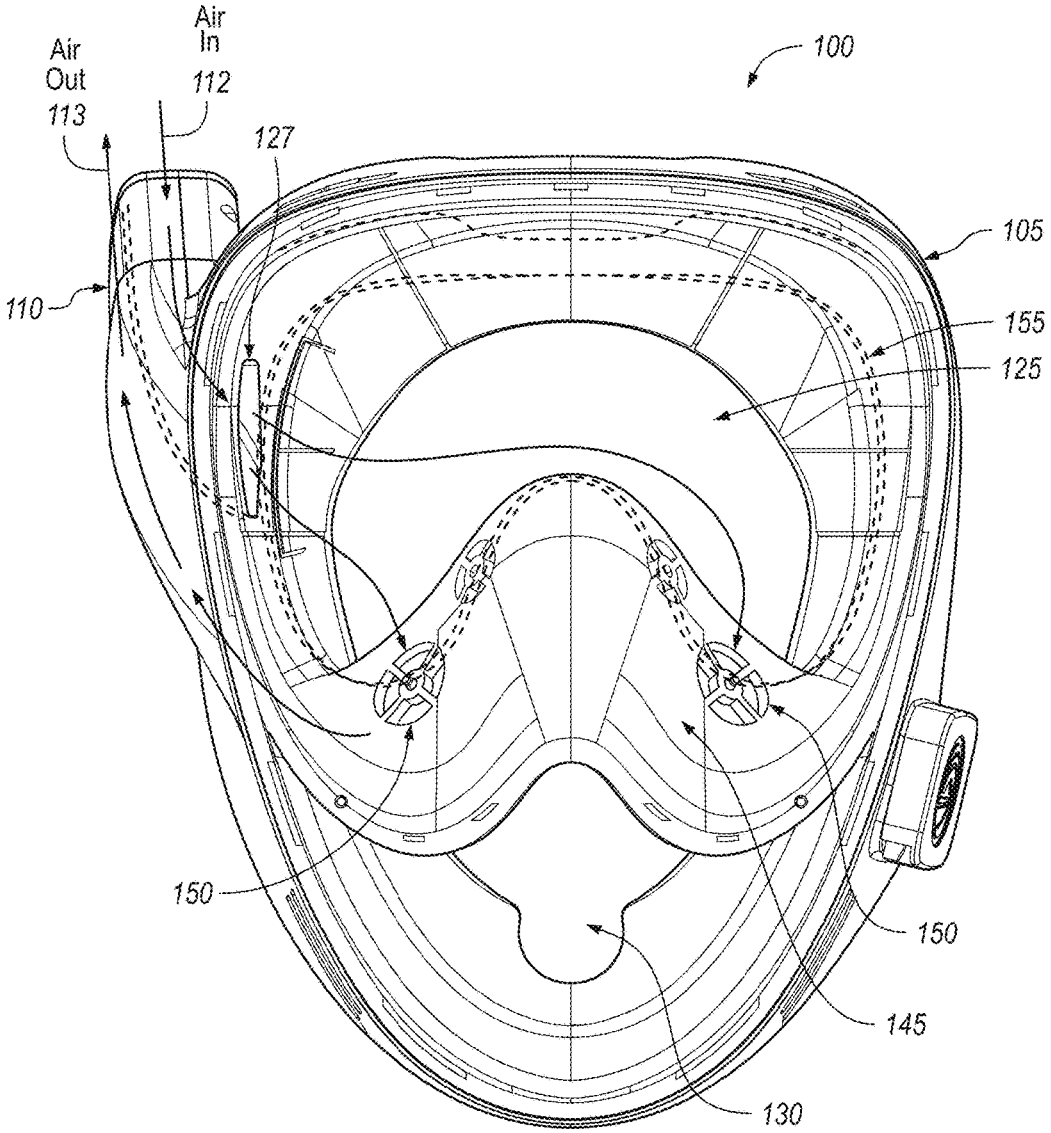

FIG. 2C illustrates a full face mask and snorkel 100 with improved lateral side-to-side circulation of fresh surface air through the first optical zone 125 of the mask 105 so as to improve clarity of vision through the lens 155 of the mask 105. For example, the first zone 125 can be disposed over the eyes of the user and the first zone 125 of the mask 105 can be encapsulated about the user's face by the lens 155 through which the user is allowed to have an underwater view.

As illustrated in FIG. 2C, circulation valves 150 are disposed on the sides of the separation seal 145. One or more circulation valves 145 are located on a side of the separation seal that is opposite or distal to the snorkel 105. In other embodiments, additional circulation valves 150 may be provided such at a plurality of circulation valves 150 are provided on each side of the bridge of the separation seal 145 as shown in FIG. 2C. Thus, in each instance as shown in FIG. 2C, surface air ("Air In" 112) enters the first chamber 125 from the snorkel 110 and is circulated to the opposite side of the mask 110 where a circulation valve 150 is disposed on the separation seal 145. As the air is drawn from the first zone 125 then into the second zone 130 during inhalation by the snorkeler a negative pressure is created within the first zone 125. This negative pressure in the first zone 125 draws unobstructed surface air from the first channel 112 of the snorkel 110 into the right side of the first zone 125. This surface air is relatively less humid than respirated air that is later exhaled by the user. The entire volume of "fresh" surface air is circulated over a greater distance of the lens 155 of the mask from the right side of the first zone 125 to the left side of the first zone 125 so as to promote evaporation of moisture disposed on the inside surface of the lens 155 of the mask 105. Drawing this fresh surface air into the first upper optical zone 125 of the mask 105 and over the interior surface of the lens 155 inhibits fogging thereof as opposed to accumulation of moisture from exhaled respirated air that is obstructed from entering the first upper optical zone 125 by the circulation valve 150 during exhalation by the user. As illustrated in FIGS. 2C and 2B, an additional or larger circulation valve 150 can be used to further promote circulation to a point where the circulation valve 150 is disposed. In this example one relatively large and one relatively small circulation valve 150 is disposed on each side of the separation seal 145, although more or less circulation valves 150 may be used. Thus, while this effect is accentuated by this example, an increased volume of side-to-side circulation is effected using the side mount snorkel even where a circulation valve is located on both sides of the separation valve as illustrated in FIGS. 1, 2A, 2B and 2C.

Referring to FIG. 2C, a deflector 127 may also be disposed at the intake channel so as to deflect the intake air away from the eyes of the user and toward the internal surface of the lens 155. According to this embodiment, the deflector 127 redirects the intake air toward the lens and circulation valves 150 as opposed to directing the air over the eyes of the user.

In the example shown in FIGS. 1 and 2A-2C the snorkel 110, intake port 135, and exhalation port 140 are disposed on the right (R) side of the full face mask 105 from the perspective of the snorkeler wearing the mask 105. But one of ordinary skill in the art will appreciate that the teachings disclosed herein can locate the snorkel 110 on the left (L) side of the full face mask 105 according to the teachings disclosed herein.

Referring again to FIGS. 1, 2A, and 2B the proximal end 110B of the snorkel 110 can be rigidly connected to the snorkel connector 160 of the mask 105. As previously mentioned, the snorkel 110 can include the first channel 112 and the second channel 113. The first channel 112 can directly provide surface air to the first zone 125 of the mask 105 and the second channel 113 of the snorkel 110 can directly receive respirated air from the second zone 130 of the mask 105 without additional air channels being disposed around the periphery of the mask 105. This lack of peripheral ducts reduces fluidic friction associated with inhalation and/or exhalation through the previously introduced peripheral ducts. Rather, separation seal 145 defines a sealed air partition between the first zone 125 and the second zone 130 and the first intake port 135 is disposed directly above and adjacent to the separation seal 145 and the second exhalation port 140 is disposed directly below and adjacent to the separation seal 145. Thus, the connector 160 of the mask 105 spans the intake port 135 and exhaust port 140 for direct fluidic access thereto. The distance between the first intake port 135 and the second exhalation port 140 on opposing vertical sides of the separation seal 145 can be defined only by a separation seal partition wall. The distance between the first intake port 135 and second exhalation port can be less than 3 inches and preferably substantially adjacent to one another separated by only a small partition there between. Thus, both the first intake port 135 and the second intake port 140 are disposed on a common side of the mask 105 and in direct communication with the inhalation channel 112 and exhalation channel 113 respectively of the snorkel 110.

The location of the side mounted snorkel 110 at a division between the upper zone 125 and the lower zone 130 created by the separation seal 145 enables a shorter distance for air to travel to and from the surface through the snorkel 110. That is, where the snorkel connection point to the mask is located on the side of the full face mask 105 and proximate to the location where the separation seal 145 meets the main seal 115 of the mask 105, the individual distance of surface air to both the first zone 125 and second zone 130 of the mask 105 is decreased. In particular, the 180 degree ducting distance to the second zone 130 from the top of the mask 105 of the prior art is eliminated. Moreover any risk of pinching or problems with peripheral air channeling as the focus of previous endeavors of the prior art can be avoided or become inconsequential as compared to that of the prior art previously discussed. Thus, a relatively lower positive and negative internal mask 105 pressure may be required by the snorkeler to draw surface air into and/or out of the full face mask and snorkel 100 according to various teachings disclosed herein.

As previously discussed WOB has been simulated and measured by the Applicant and results in a reduction in WOB between 67% and as high as 91% over other full face masks such as those discussed in the Background. This improvement in the reduction of WOB is a vast improvement over previously available designs and was accomplished by the inventors of this patent application by moving the snorkel 110 to the side of the mask 105 where it may directly span the separation seal 145 of the mask 105 and directly access the optical intake chamber 125 and directly access the lower respiratory exhalation chamber 130.

During use, the distal end 110A of the snorkel 110 is typically disposed above water level when the user is breathing surface air. In such instances where the snorkeler decides to dive to a depth drawing the distal end 110A of the snorkel 110 below the surface of the water the snorkel can include means for occluding the channels of the snorkel 110 in the form of a float valve. The float valve can include a float 122 held within a float guide channel 123, the guide channel 123 having a proximate end and a distal end of the guide channel 123 corresponding with the direction of the distal end 110A and proximate end 110B of the snorkel 110. The float 122 may have curved end and a flat end in the shape of a bullet so as to allow the curved or angled end of the float 122 to properly seat with a corresponding seal 124. The guide channel 123 can hold the float 122 within the guide channel 123 and allow the float 122 to move within the guide channel 123 under a buoyancy of the float 122.

The float 122 can have a substantially cylindrical, round, or conical end for engaging an opening of the float seal 124. The float 122 can be made of a polymer, such as plastic or rubber, and is hollow thereby encapsulating an air chamber therein. Buoyancy of the float 122 is an upward force exerted by the water that opposes the weight of float 122 when submerged. Thus the pressure on the bottom of the float 122 when submerged in water is greater than at the top of the float 122 causing a net upwards force on the float 122 and causing the float 122 to move within the float channel 123 towards the distal end 110A of the snorkel 110A. When the distal end 110A of the snorkel 110 is submerged, along with the float 122 within the float channel 123, the float 122 is urged upwards and moves within the guide channel 123 toward a float valve seal 124. The float valve seal 124 includes a hole sized so as to be obstructed by the body of the float 122 when submerged. The float seal 124 can operate along with the float 122 and float channel 123 as one example of means for occluding both air supply channel 112 and exhaust channel 113 when the snorkel 100 is submerged.

Figure 3A:
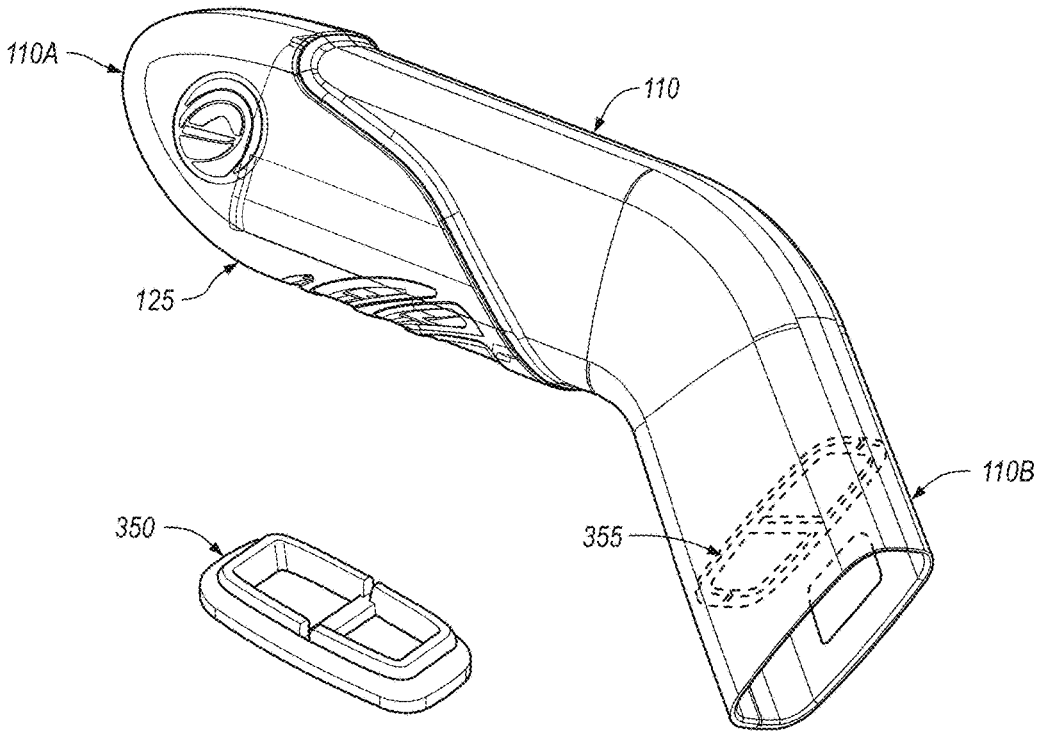
FIGS. 3A and 3B illustrate an optional internal snorkel seal.
Figure 3B:
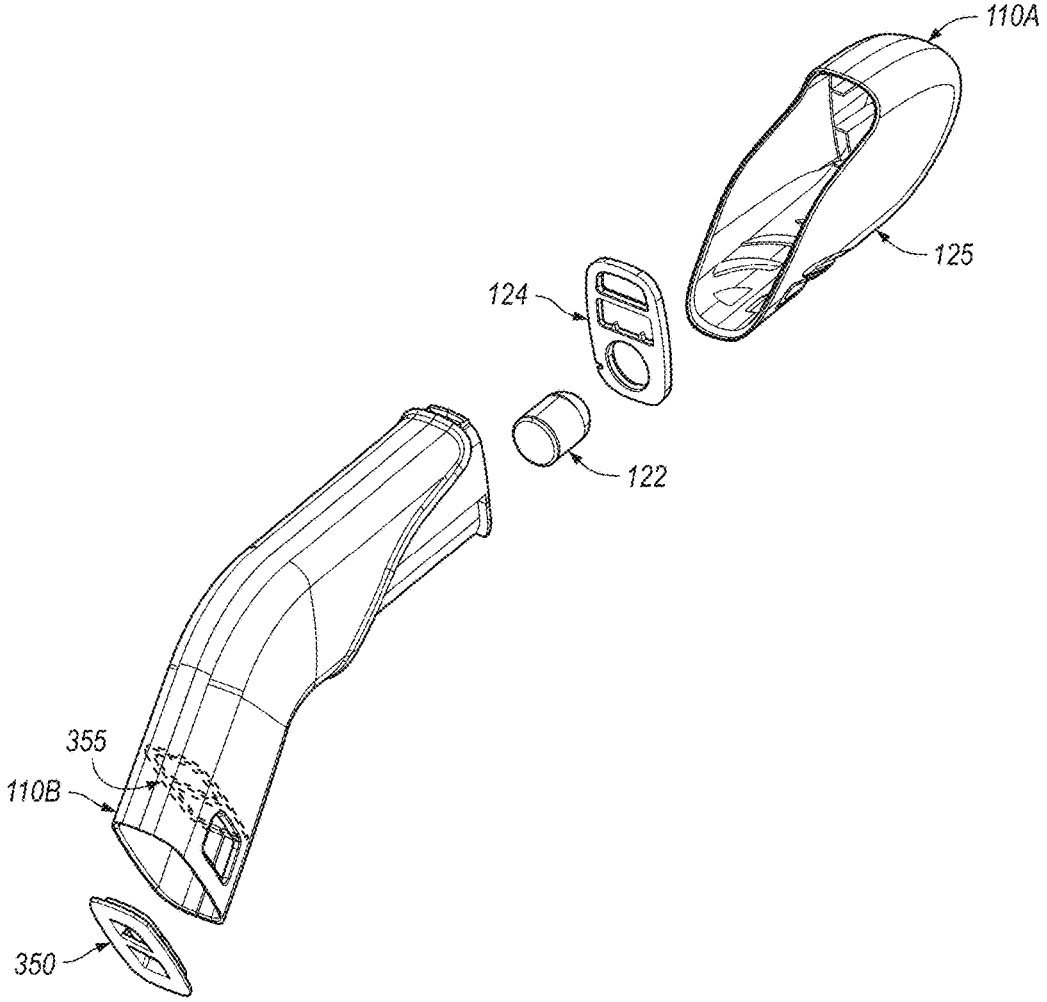

Referring to FIGS. 3A and 3B an inner snorkel tube gasket seal 350 can be inserted and seated within the distal end 110B of the snorkel 110. The inner snorkel tube gasket seal 350 is configured to mate with a corresponding edge or seal of a connector 160 of the mask 105. FIG. 3B shows an exploded view of the inner snorkel tube gasket seal 350 prior to assembly. As shown in FIG. 3B the interior of the snorkel tube includes a plastic seat 355 molded therein to which the snorkel tube gasket seal 350 is held in place.

Figure 3D:
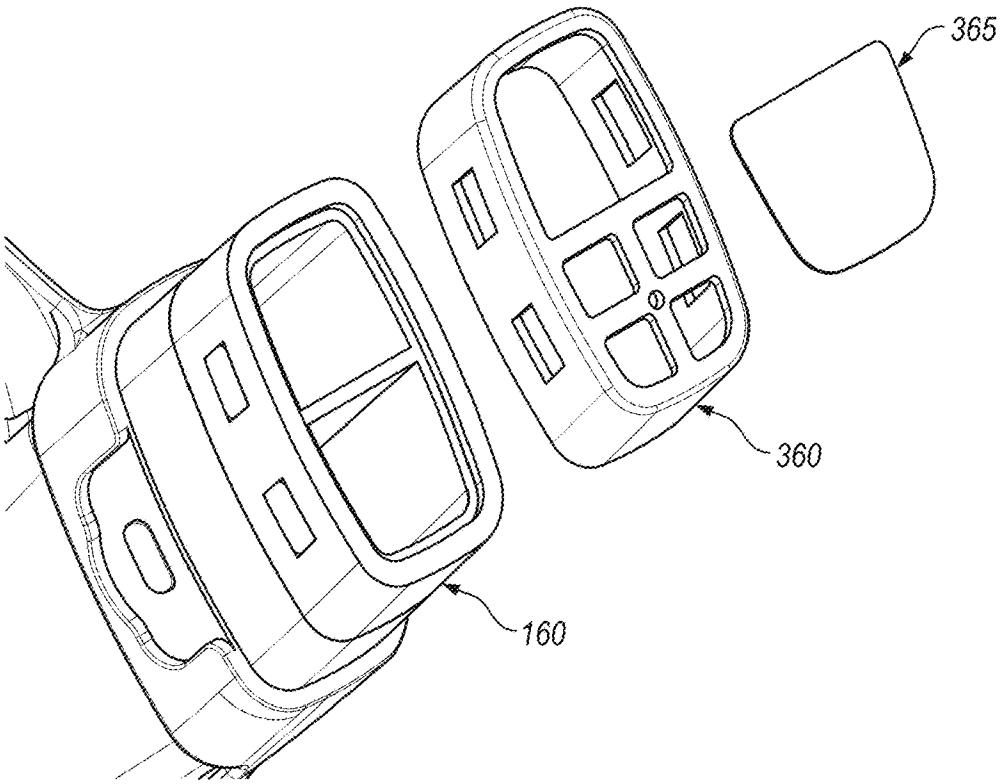
FIGS. 3C and 3D illustrate an example of an optional exhaust valve.
Figure 3C:
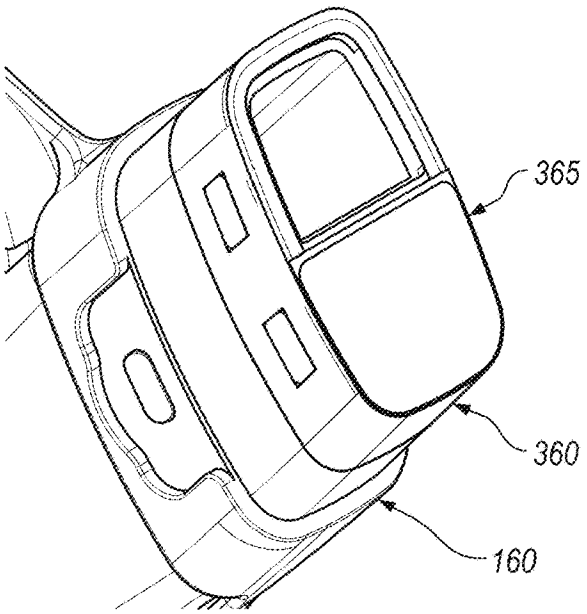

Referring to FIGS. 3C and 3D, an example of an exhalation valve insert 360 is illustrated and may be provided according to certain embodiments. In this example, the exhalation valve insert 360 is inserted between the snorkel connector 160 of the full face mask 105 and the snorkel (not shown). The exhalation valve insert 360 includes a one-way exhalation valve 365 disposed in the exhalation channel. The exhalation valve 365 allows for exhaled air to exit the snorkel, but prevents the exhaled air that passes the exhalation valve 365 but is still within the snorkel to be re-inhaled. Thus, during inhalation, the exhalation valve 365 blocks the exhaled air within the exhalation channel from being drawn back into the respiration chamber of the full face mask.

Figure 4A:
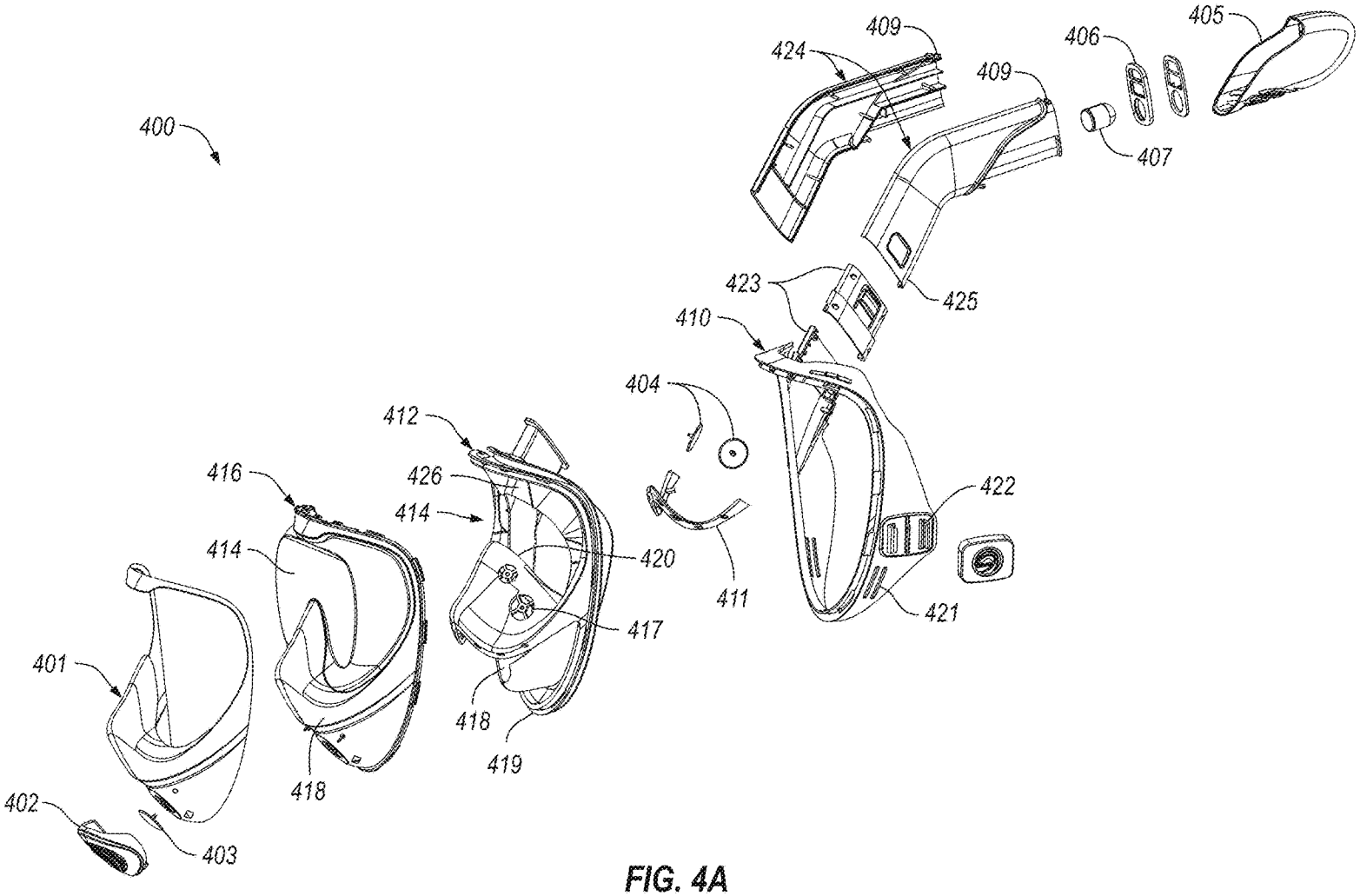
FIG. 4A illustrates an example of the components for assembly of the full face mask and snorkel including a full face mask and rigidly attached side mount snorkel.

FIG. 4A illustrates several components of a full face mask and snorkel 400 along with methods of manufacturing and assembling the full face mask and snorkel 400. FIGS. 4B-4G show multiple views of the assembled full face mask and snorkel 400 from various angles. Referring to FIG. 4A, a combination full face mask and snorkel 400 includes an over molded mask cover 401. The full face mask further include a clear mask transparent lens component 416. The full face mask includes a drain valve 403 and drain valve cover 402.

The full face mask includes one or more circulation valves 417 for one-way circulation through a separation seal 420 of a flexible seal component 412 during inhalation. The flexible seal component 412 can include a silicone resilient material to define a main seal 426 and the separation seal 420. The main seal 426 of the silicone component 412 of the full face mask extending around the outer periphery thereof. The separation seal 420 isolating a first upper optical zone 412 from the lower respiratory zone 418 as covered by the clear lens component 416 when affixed thereto in a water-tight manner against the face of the snorkeler during use. The full face mask further includes a nose bridge backing plate 411 for providing additional structural support to the nose bridge portion of the separation seal 420 so as to provide additional support against the separation seal 420 in the location of the bridge of the nose of the snorkeler and to increase the seal between the first zone 414 and the second zone 418 of the full face mask. The full face mask further includes separation seal valve gaskets 404 for allowing for air to be drawn from the first zone 414 into the second zone 418 during inhalation, but preventing air from being drawn from the second zone 418 into the first zone 414 during exhalation.

The full face mask includes a rigid support structure including a mask back body 410. The mask back body 410 defining a mask rigid connector 423 for connection to a snorkel rigid connector 425 of a snorkel 424. The mask back body 410 can include multiple strap connectors 421 disposed about a periphery of the mask back body 410. The mask back body 410 can further include one or more attachment features 422 for attaching an underwater accessory such as an underwater camera for recording the underwater environment.

The full face mask and snorkel 400 further includes the snorkel 424 and the snorkel connector 425 for rigid connection of the snorkel 424 to the rigid mask connector 423 of the mask back body 410 of the full face snorkel. The snorkel 424 further includes a distal end 409 to which a float valve assembly is assembled. The float valve assembly includes a float 407, a float seal gasket 406 and snorkel float cover 405.

Figure 4B:
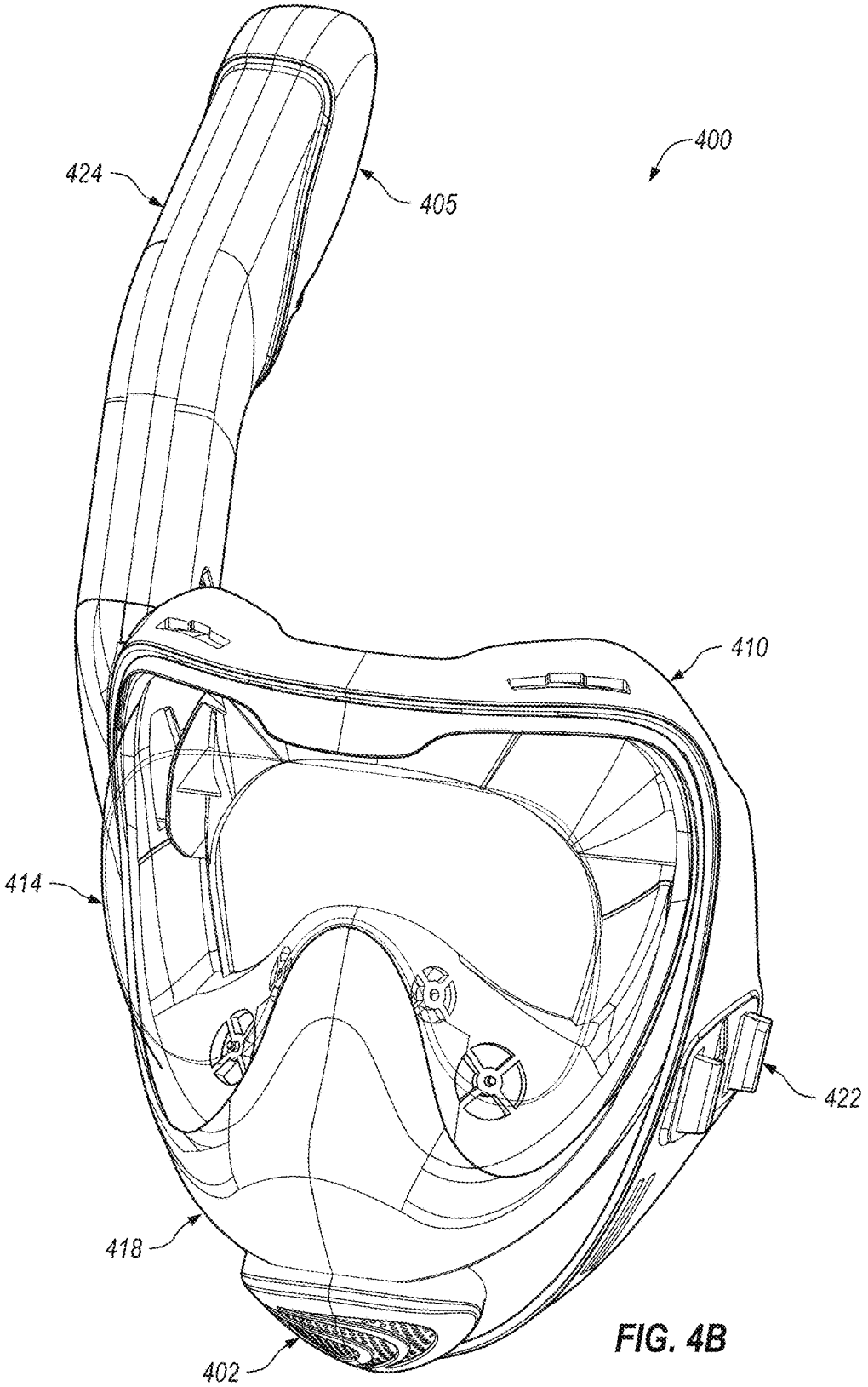
FIG. 4B illustrates the assembled full face mask and snorkel from a front right perspective.
Figure 4C:
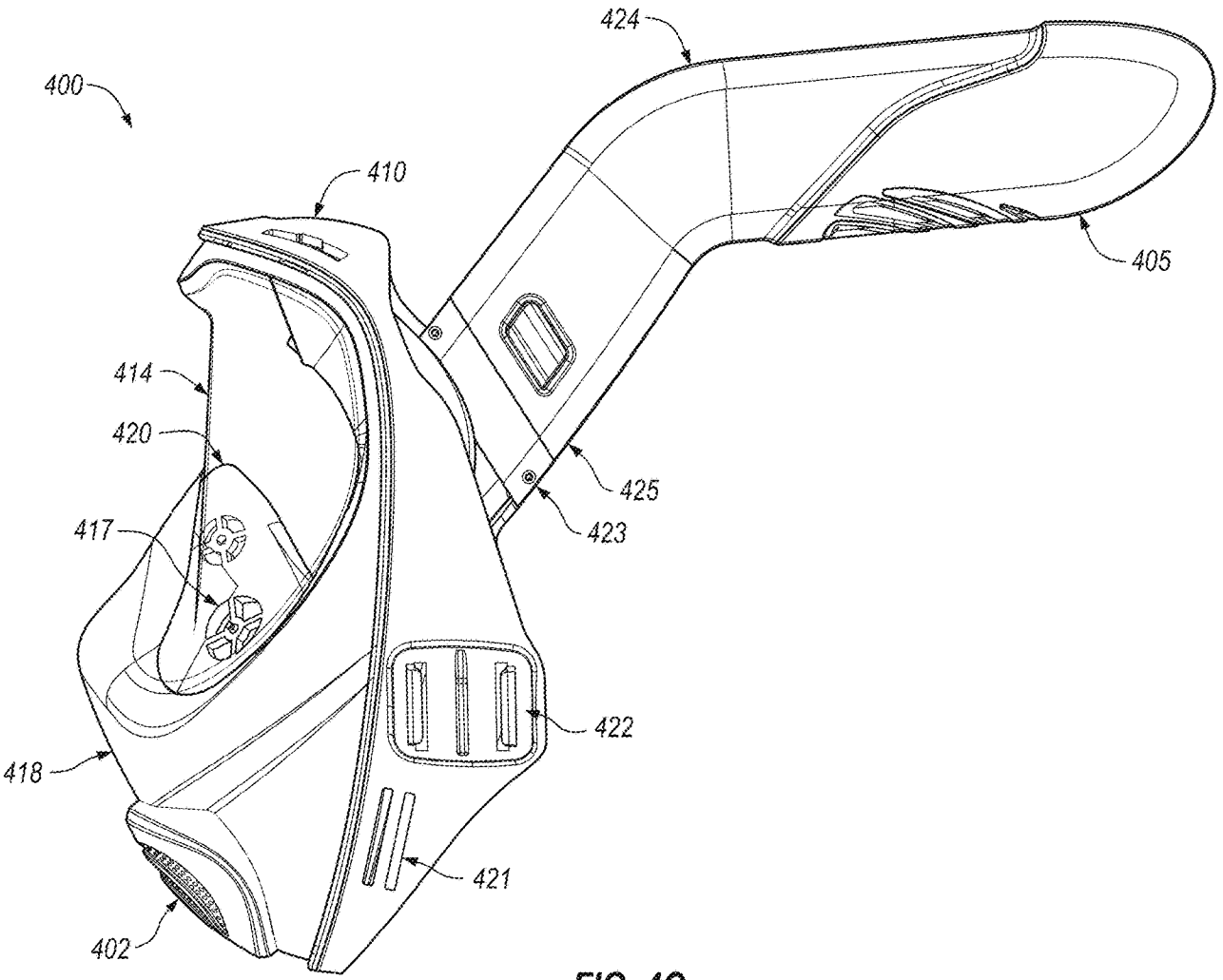
FIG. 4C illustrates the assembled full face mask and snorkel from a left side.
Figure 4D:
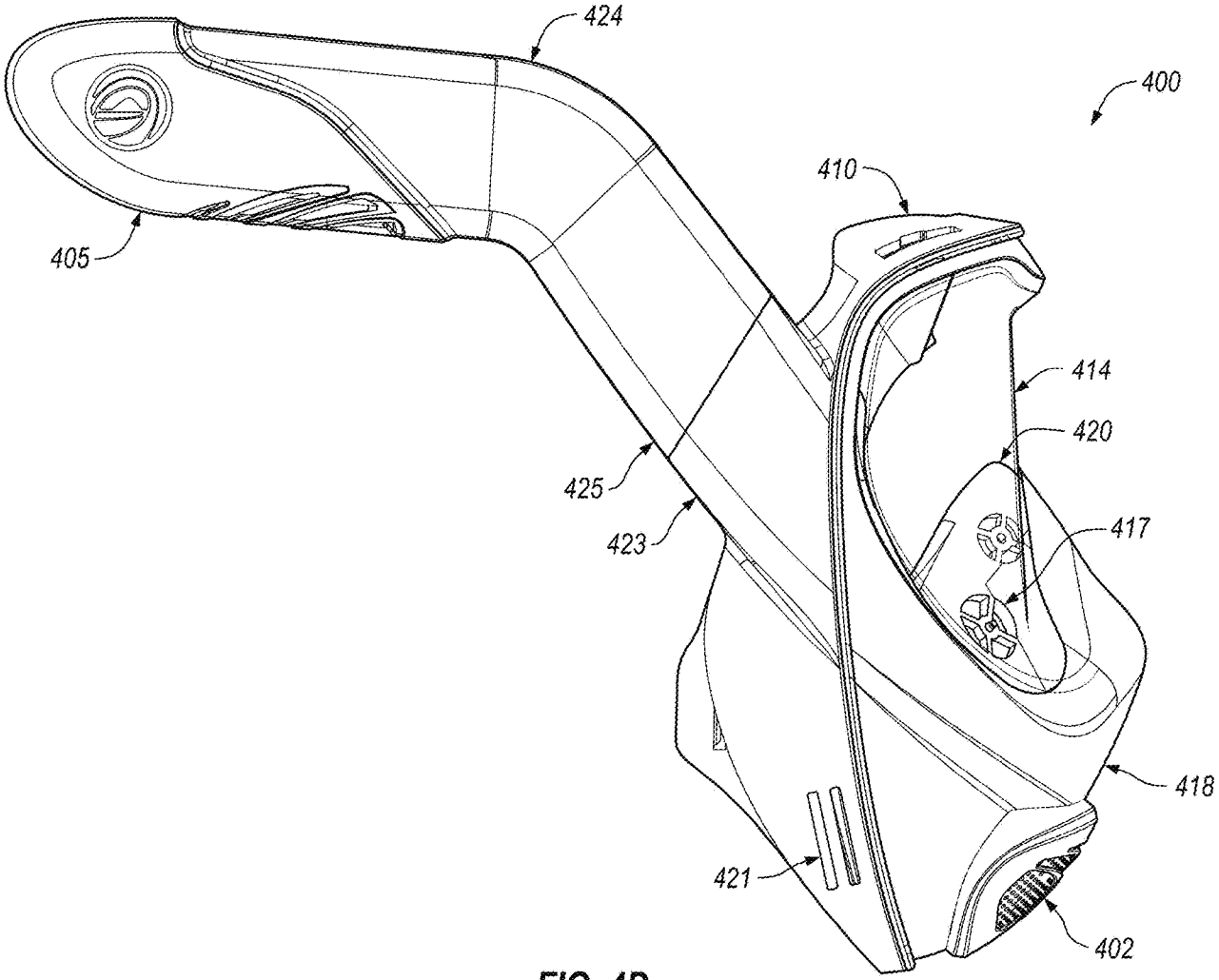
FIG. 4D illustrates the assembled full face mask and snorkel from a right side.
Figure 4E:
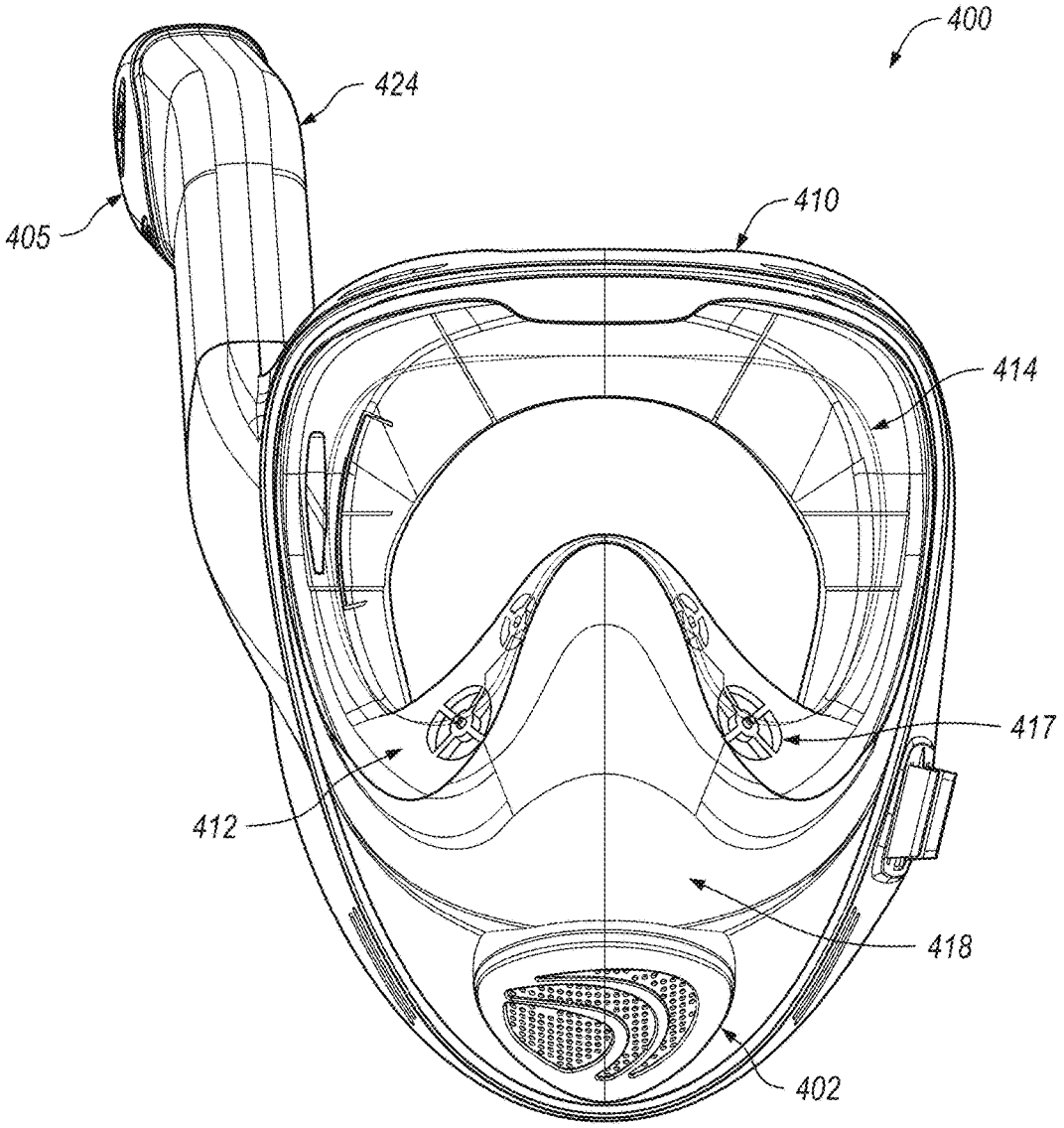
FIG. 4E illustrates the assembled full face mask and snorkel from a front view.
Figure 4F:
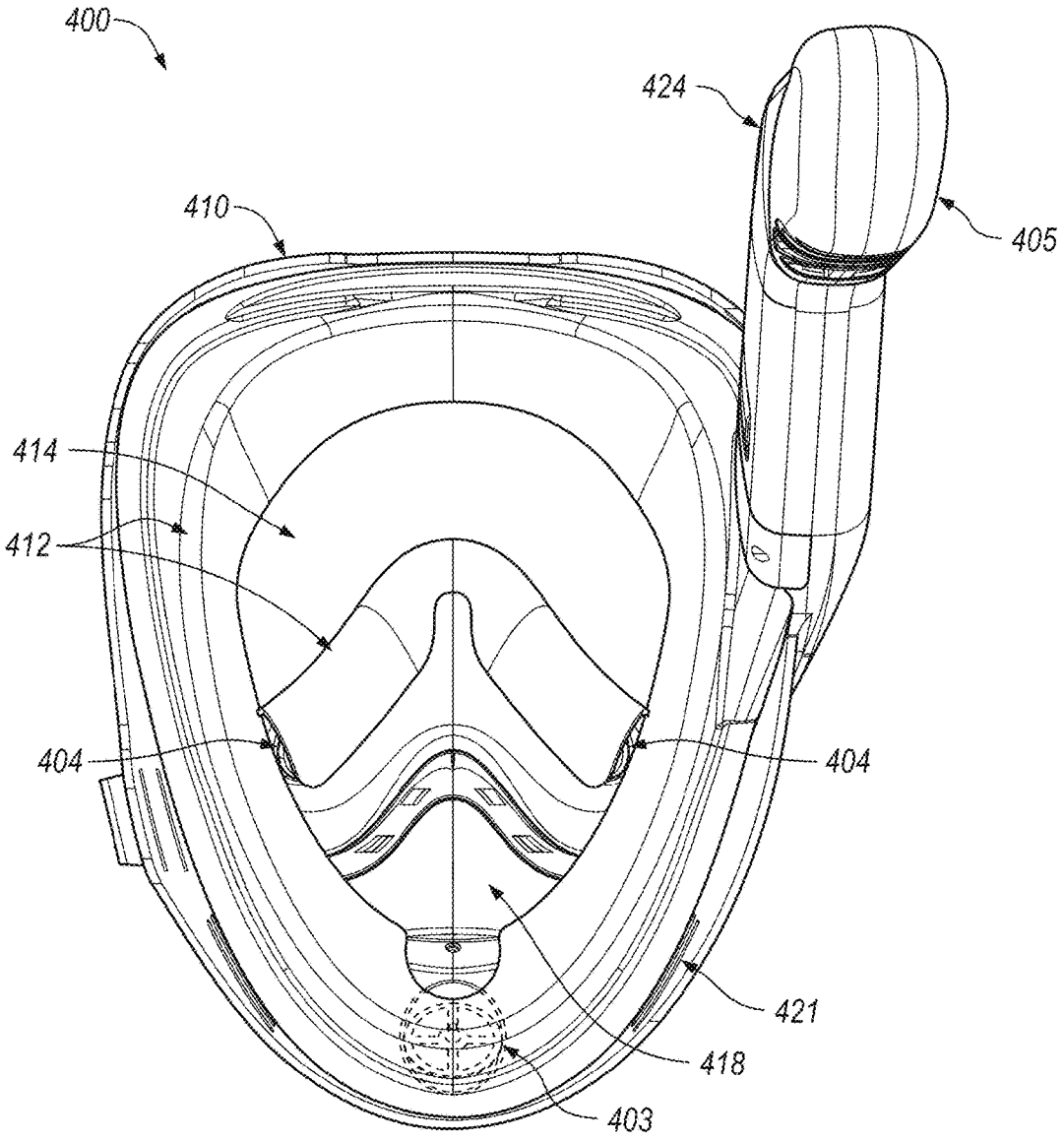
FIG. 4F illustrates the assembled full face mask and snorkel from a rear view.
Figure 4G:
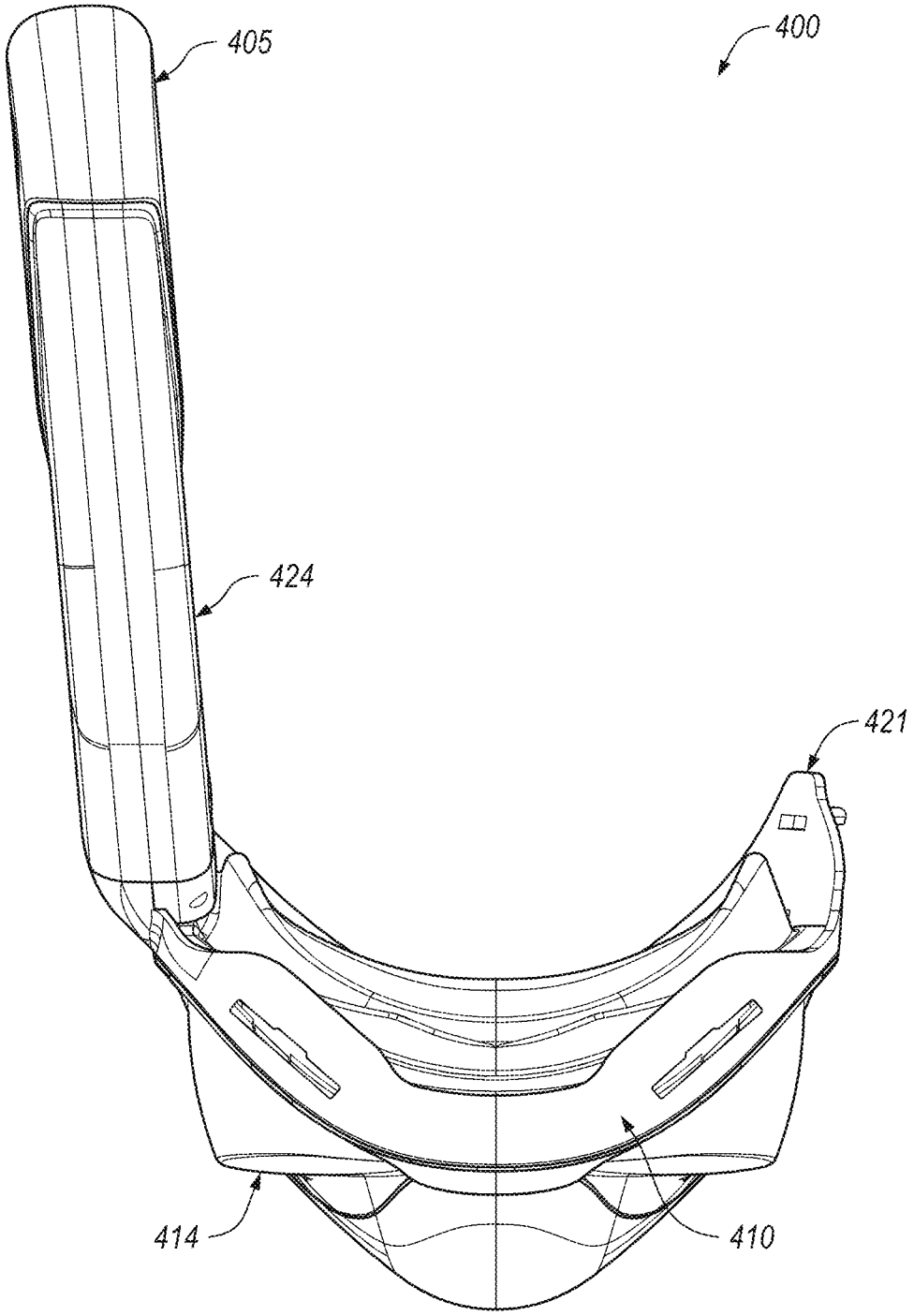
FIG. 4G illustrates the assembled full face mask and snorkel from a top view.
Figure 4H:
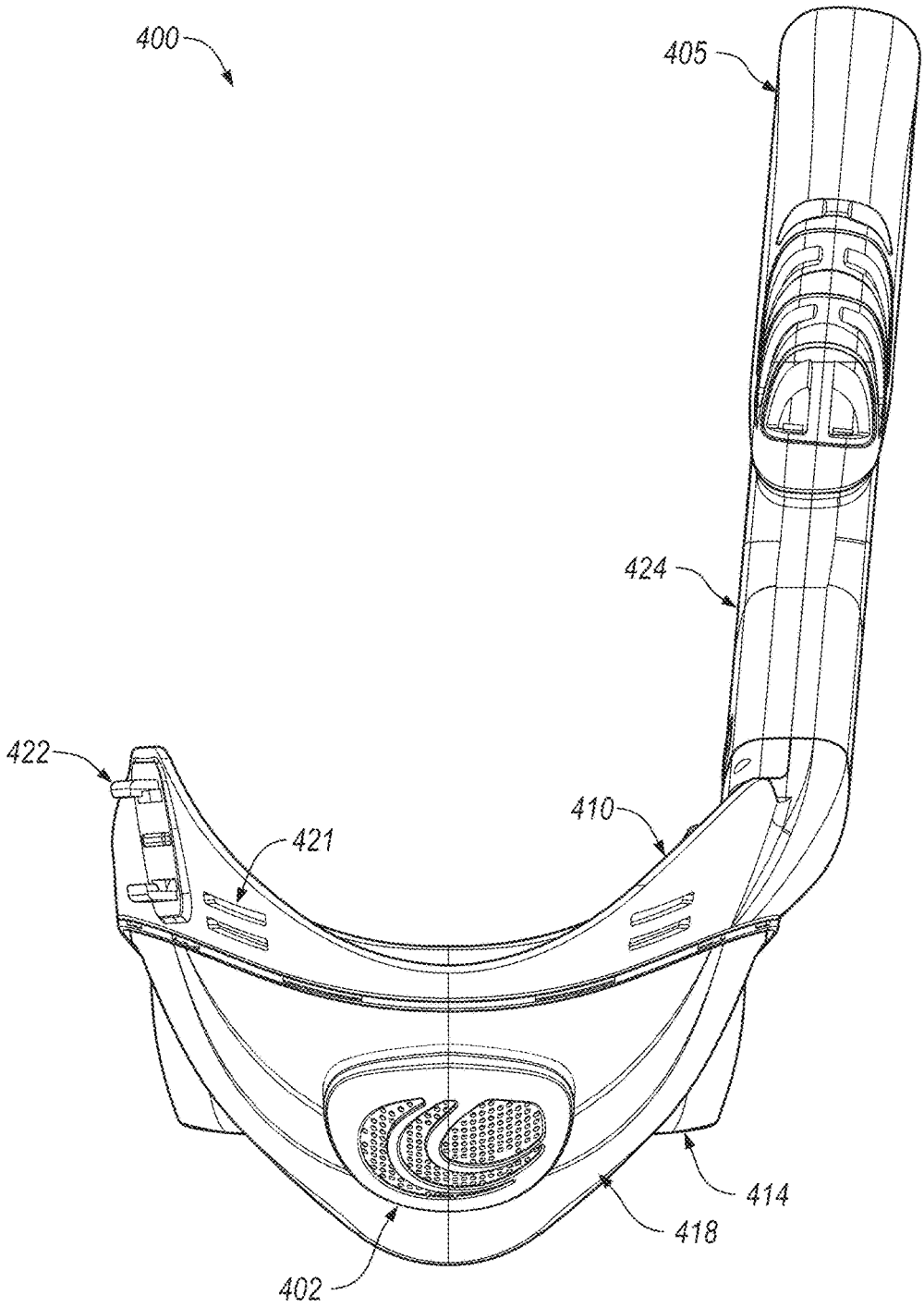
FIG. 4H illustrates the assembled full face mask and snorkel from a bottom view.

FIG. 4B shows the assembled full face mask and snorkel 400 of the components illustrated in FIG. 4A from a right front perspective view. FIG. 4C shows the assembled full face mask and snorkel 400 of the components illustrated in FIG. 4A from a left view. FIG. 4D shows the assembled full face mask and snorkel 400 of the components illustrated in FIG. 4A from a right view. FIG. 4E shows the assembled full face mask and snorkel 400 of the components illustrated in FIG. 4A from a front view. FIG. 4F shows the assembled full face mask and snorkel 400 of the components illustrated in FIG. 4A from a rear view. FIG. 4G shows the assembled full face mask and snorkel 400 of the components illustrated in FIG. 4A from a top view. FIG. 4H shows the assembled full face mask and snorkel 400 of the components illustrated in FIG. 4A from a bottom view.

Figure 5:
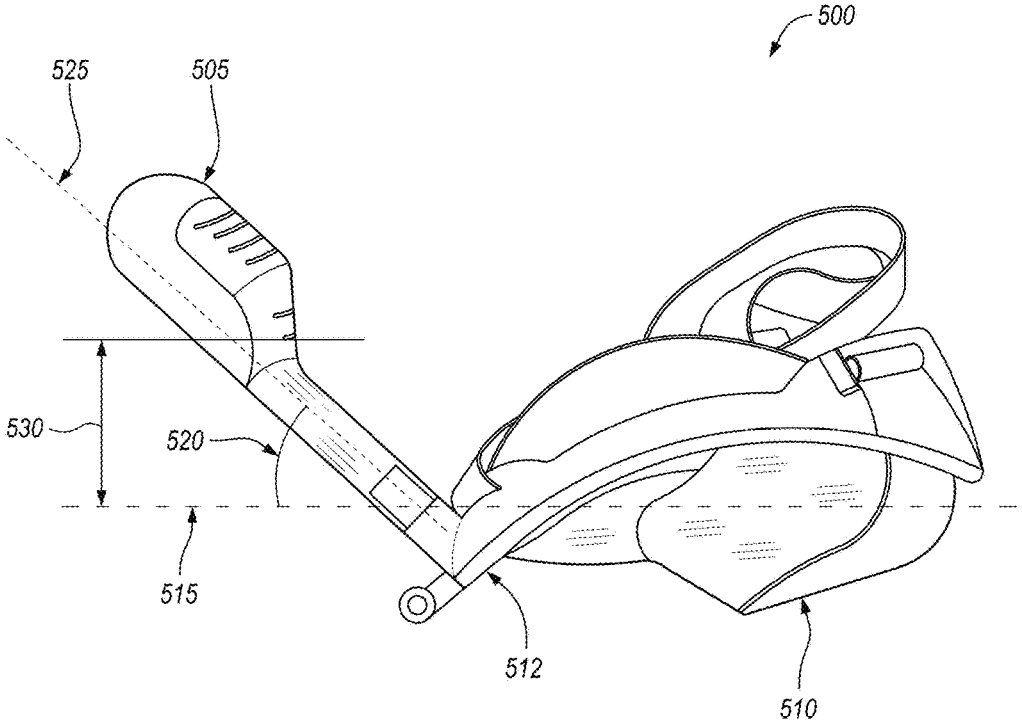
FIG. 5 PRIOR ART
FIG. 5 illustrates a traditional snorkel according to the prior art.
Figure 6:
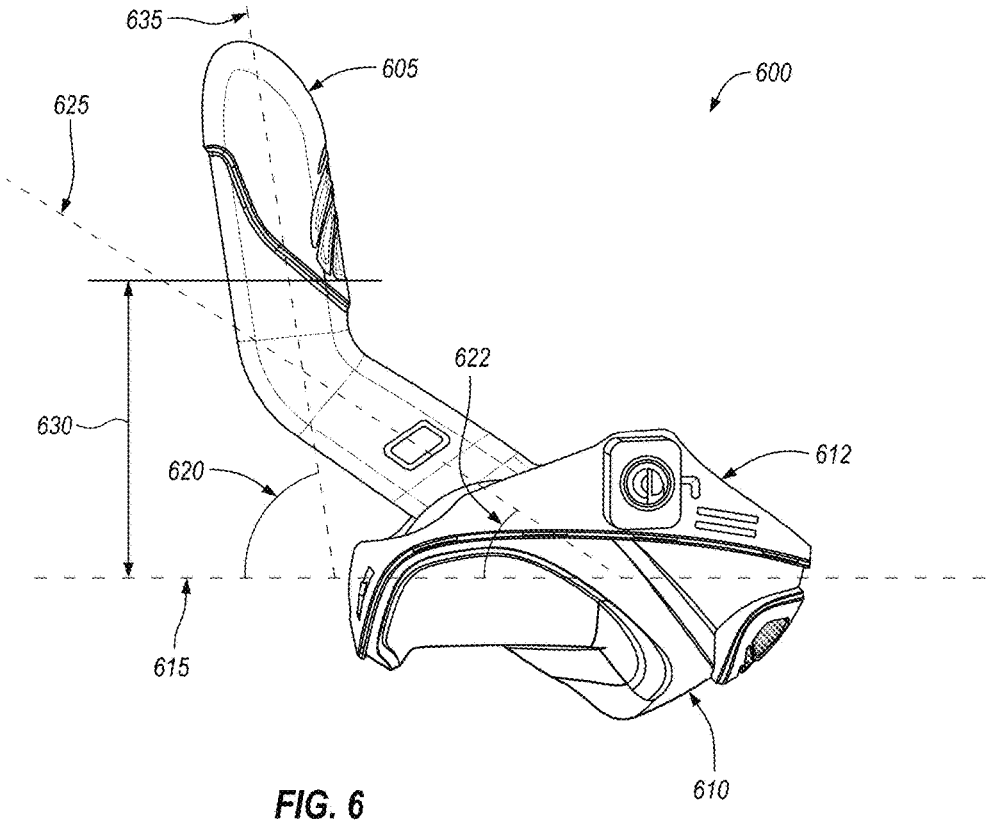
FIG. 6 illustrates improvements in snorkel design according to various embodiments of the present invention.

Referring to FIGS. 5 and 6 an additional advantage of the full face mask and snorkel of the prior art as compared to the traditional full face mask and snorkel disclosed herein is illustrated. FIG. 5 shows the traditional prior art full face mask and snorkel 500 discussed in the Background where the snorkel 505 is attached to the mask 510 at a center forehead position. FIG. 6 shows the full face mask and snorkel 600 according to an embodiment of the present invention. The dotted horizontal line 515 in FIG. 5 and dotted horizontal line 615 in FIG. 6 illustrate a theoretical horizontal waterline 515 and 615 during use of the full face mask and snorkel 500 and 600 respectively. The horizontal water lines 515 and 615 can be a horizontal top surface of a body of water within which the snorkels 500 and 600 are disposed during use. Although the water surface 515 and 615 is illustrated by a linear dotted line one of skill in the scuba arts would understand that the water is often uneven or perturbed and the masks 500 and 600 may be disposed at a deeper depth, or more shallow depth during use. One of ordinary skill in the snorkeling arts would also appreciate that the snorkeler is moving her head and the mask during use which is an important aspect of the comparison of FIGS. 5 and 6 and the marked improvement of the designs disclosed and claimed herein.

FIG. 5 illustrates the conventional full face snorkeling mask 500 with a relatively straight snorkel 505 disposed on the upper forehead region of the mask 510. As shown in FIG. 5 the snorkel 505 extends in a single acute angle 520 from the waterline 515 relative to the frame of the conventional mask 510. During use it has been found by the inventors of this patent application that this single acute angle 520 of the prior art snorkel having a tope forehead connected snorkel relative to the water surface can be disadvantageous and create a higher likelihood that the lowest vents of the snorkel 505 may be inadvertently lowered into the water causing water to enter the snorkel 505 at an unintended moment during use.

Referring to FIG. 6, the new and innovative design is illustrated with a snorkel 605 disposed on the side of the mask and having a shape that extends in multiple directions relative to the waterline 615 and frame of the mask 610. That is, the snorkel 600 of FIG. 6 extends in a first direction 625 at a first acute angle 622 relative to the water surface 615 and frame of the mask 610 and also extends in a second direction 635 at a second acute angle 620 relative to the water surface 615. In the embodiment of FIG. 6 the snorkel 605 first extends from the frame 612 of the mask 610 at the first angle 622 relative to the water surface 615 and the frame 612 of the mask 610 and then extends along a second length at an additional greater angle 620 relative to the water line 615 and the face plate 612 of the mask 610. This design allows for the snorkel to be directed more perpendicular to the water surface during use in the prone position yet also be held out of the water in an upward position when the snorkeler is floating vertically.

In this embodiment, the snorkel 600 is disposed on the side of the mask 610 as discussed herein but such teaching regarding the multi-angled snorkel 605 can be applied according to other embodiments. When in an upright position (not shown) the extension of the snorkel 605 according to the smaller first acute angle 622 can provide a snorkel position above a water line when in a more upright position whereas the second angle 620 can provide the more perpendicular angle 620, or closer to 90 degrees, relative to the waterline 615 when in use during snorkeling as shown in FIG. 6. Thus, the first acute angle 622 can provide a more upright position of the snorkel 605 when the snorkeler is in an upright position in the water and the second acute angle 620 can provide a more perpendicular position of the snorkel 605 when the snorkeler is swimming horizontal to the waterline 615 as shown in FIG. 6.

As illustrated by a comparison of FIG. 5 to FIG. the distances 530 and 630 of the lowest vent above the waterlines 515 and 615 can be increased by using this multi-angled snorkel design when in use according to the teachings disclosed herein. In the comparison of the illustrations of FIGS. 5 and 6 the distance above the waterline 630 in FIG. 6 can be increased by almost double the distance above the waterline as compared to distance 530 in FIG. 5. Any increase in distance above waterline such as at least a 20% increase in distance above the waterline due to the multi-angle snorkel 605 design disclosed herein can be especially advantageous especially when combined with the disposition of the snorkel 605 on the side of the mask 610 as illustrated in FIG. 6. This increase in distance 630 shown in FIG. 6 further allows for the user to view greater underwater areas without inadvertently submerging the snorkel as is the case in FIG. 5 with regard to the prior art.

Figure 7:
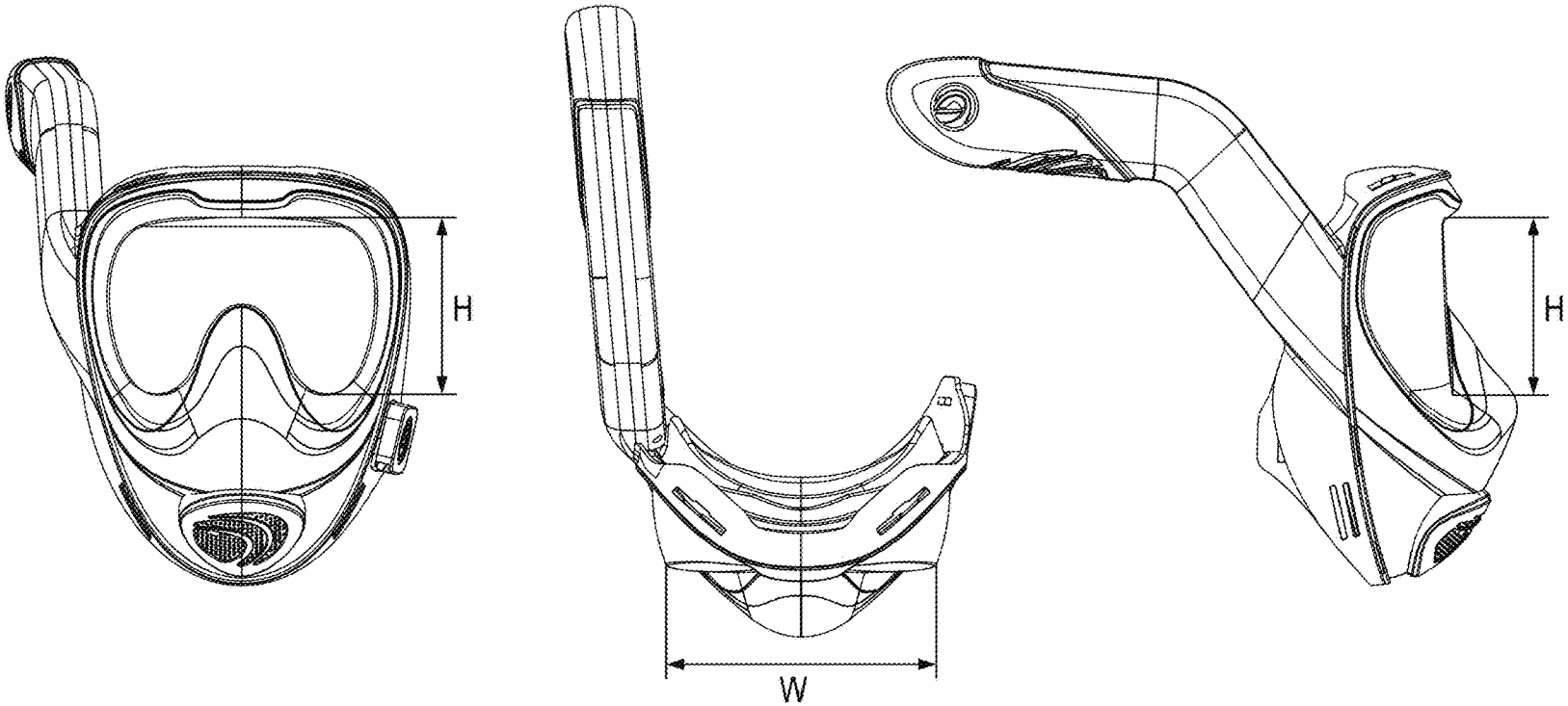
FIG. 7 illustrates improvements in the size of the viewable area of the mask according to embodiments of the present invention.

Referring to FIG. 7 a planar viewing area of the lens of the full face shield can be increased according to the embodiments disclosed herein. Use of a planar viewing area decreases distortion as opposed to curved transparent lens surfaces. Thus, the height (H) and width (W) can be increased according to the teaching disclosed herein. For example, the height (h) may be increased to at least four inches in planar height and the width (W) may be increased to at least 6 inches in planar width with a more abrupt change in direction as opposed to the prior art resulting in an increase in undistorted viewable area.

Another improvement disclosed herein is related to methods and apparatus for reducing the likelihood of having the inhalation of surface air inadvertently "cut off" during normal surface snorkeling inhalation as opposed to solely during submersion of the snorkel. This problem of undesirable inhalation obstruction due to movement of the float during surface snorkeling is caused by negative and positive air pressure created during inhalation by the circulation of air drawn into the snorkel and over the float. Such undesirable obstruction of inhalation during surface snorkeling is an unenjoyable experience. Moreover, reducing the likelihood of inadvertent movement of the float to block inhalation during surface snorkeling is also important for improved safety during such snorkeling activity.

Figure 8A:
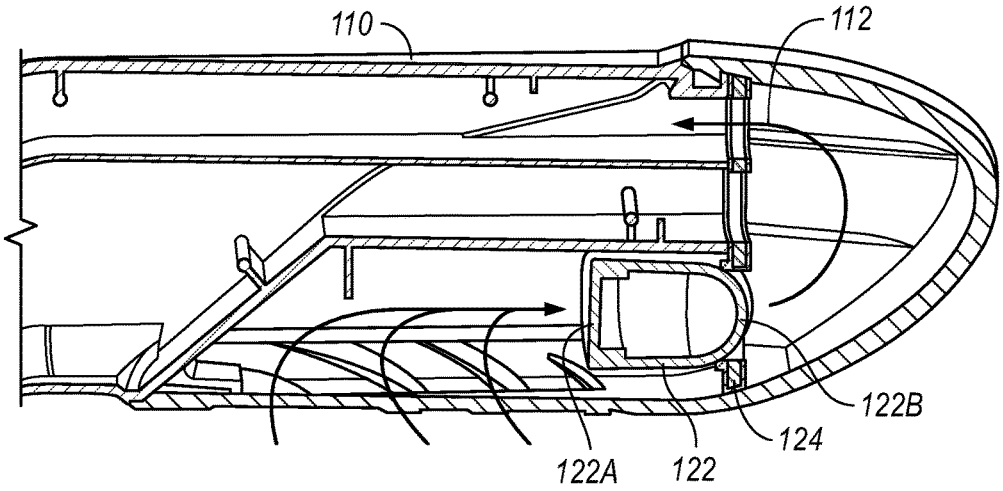
FIGS. 8A, 8B, 8C, and 8D illustrate improvements in a snorkel float valve.

FIG. 8A illustrates a problem in some embodiments disclosed herein where the float 122 of the snorkel 110 may be too easily drawn into engagement with the float seal 124 during inhalation as opposed to only during submersion. As shown in FIG. 8A, when inhaling, a difference in pressure is created on opposing sides of the float 122. Inhaled surface air can create a positive pressure at the rear side 122A of the float 122 pushing the float toward the float seal. In addition, a negative pressure is created in the front side 122A of the float as the inhaled air is drawn into the snorkel. This pressure on the rear side 122A and suction on the front side 122B of the float 122 increases the likelihood that the float 122 is drawn toward the seal 124 during surface snorkeling inhalation as opposed to only in the condition of submersion.

Figure 8B:
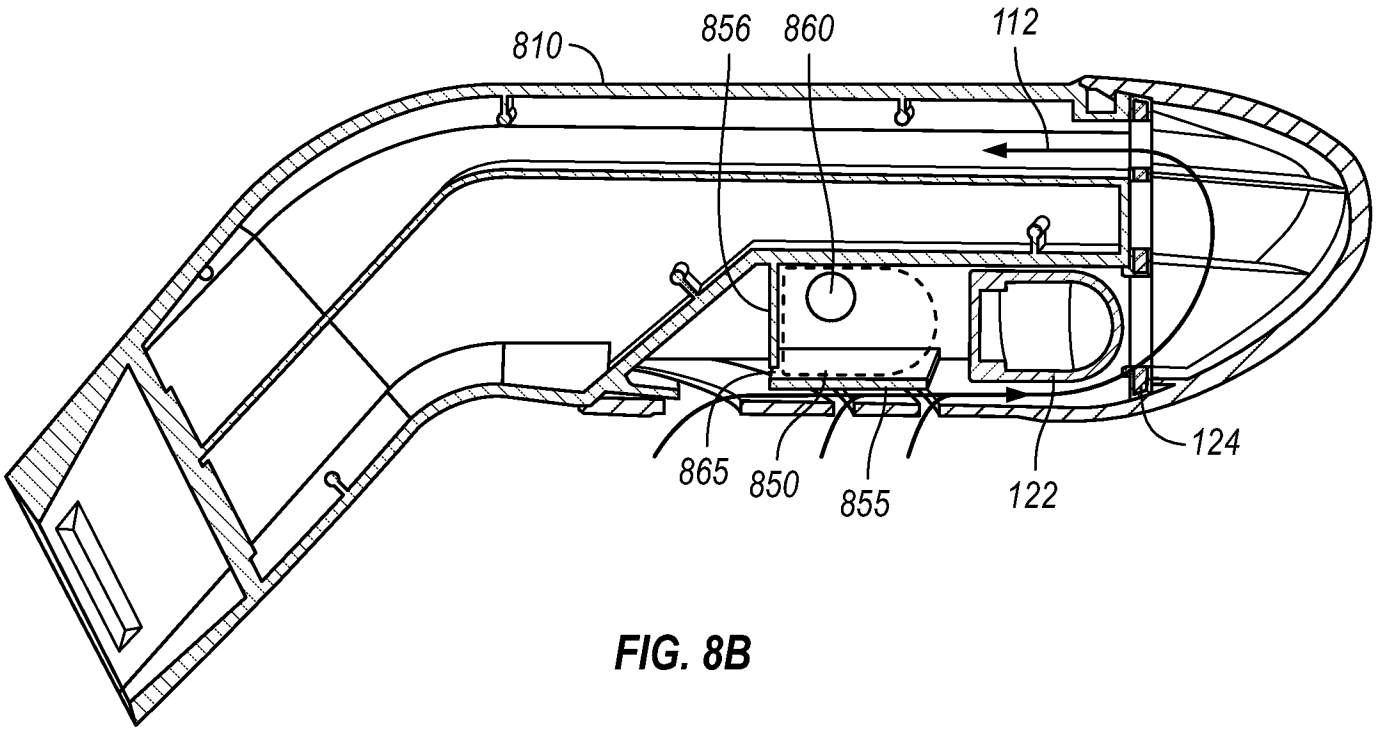
Figure 8C:
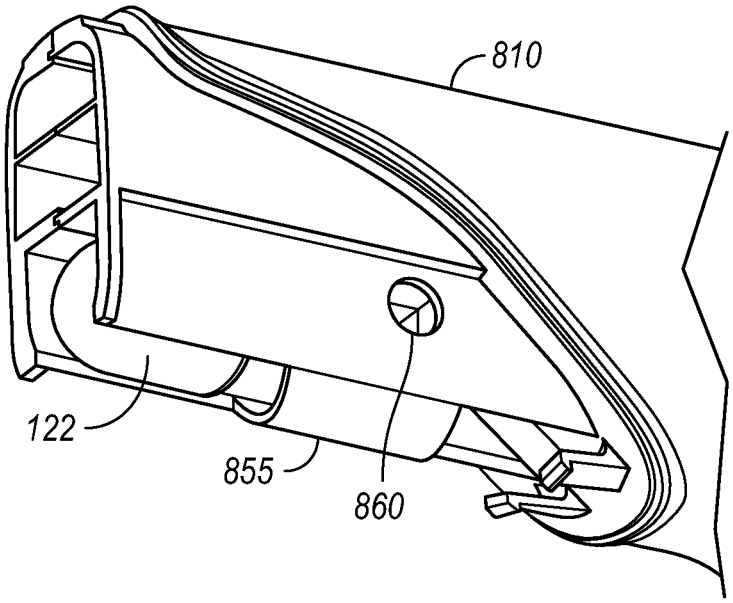
Figure 8D:
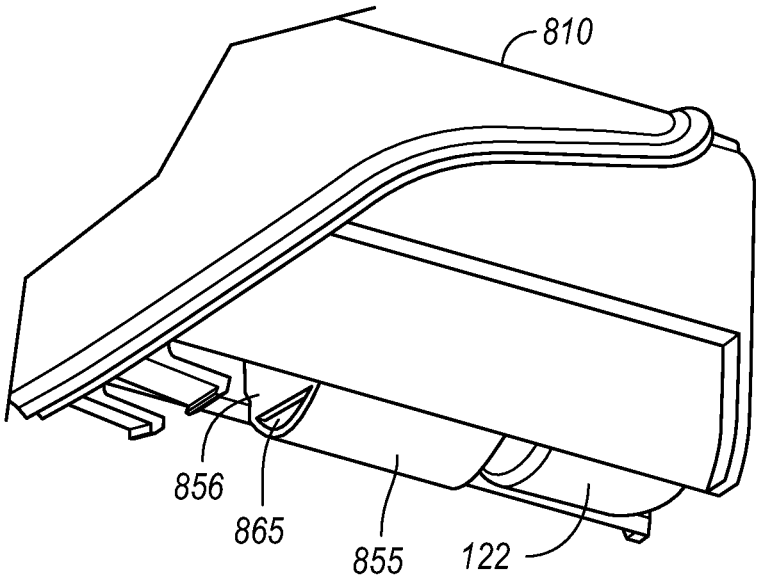

Referring to FIGS. 8B, 8C, and 8D an optional improved snorkel 810 is illustrated. The snorkel 810 includes one or more means for inhibiting undesirable movement of the float during surface inhalation and may be apparent to any draw snorkel. This improvement to the snorkel 810 includes a float chamber 850 with one or more sidewalls 855 and a rear 856 that at least partially surround the chamber 850 within which the float 122 is held in a retracted surface breathing position. The float chamber 850 includes the one or more sidewalls 855 and rear 856 which partially encapsulate the float 122 during surface snorkeling inhalation and reduce the likelihood, or prevent, inhaled air from drawing the float 122 into engagement with the float seal 124. This protective pocket created by the float chamber 850 creates a more neutral pressure position for the float 122 over which inhaled air is drawn which is substantially less susceptible to the positive and negative pressures to the float itself 122 as illustrated in FIG. 8A.

The sides 855 and or rear 856 of the float chamber 850 can include one or more apertures for allowing water to enter the float chamber when the snorkel is submerged thereby allowing the float 122 to engage the seal 124 upon submersion. For example, FIGS. 8B, 8C, and 8D illustrate an example of a small hole 860 on the side 855 of the float chamber 850 and snorkel 810 and a small opening 865 at the rear 856 of the float chamber 850 allowing for water to enter the float chamber 850 when the snorkel is submerged causing the float 122 to only then engage the seal 124. When not submerged and being used for surface snorkeling the float 122 is held within the chamber 850 and surrounded by the sides 855 and rear 856 of the float chamber 850 reducing the flow of inhaled air over the float and application of the positive and negative pressures produced by the inhalation of surface air 112 to the float 122. As a result, the likelihood that the float 112 is undesirably drawn to the float seal 124 during normal surface snorkeling inhalation is substantially reduced.

The previously discussed isolated optical and respiration zones disclosed herein can provide means or method of respiration and means for air circulation. During a negative pressure inhalation phase the user inhales surface air through the first channel of the snorkel. This inhalation phase is created by the user breathing air into their nose and mouth from the second lower zone of the full face mask. By breathing air into the user's lungs a negative pressure is created within the second zone of the full face mask drawing air from the first channel of the snorkel into the first upper zone of the full face mask. This air is circulated over a clear transparent lens of the mask inhibiting fogging using the fresh surface air drawn from the snorkel into the first upper zone of the mask. As disclosed herein, the snorkel is disposed on a side of the mask proximate to an end of a separation seal of the mask where the first intake and second exhaust ports of the snorkel directly mate with the first upper and second lower zones of the mask enabling direction intake of surface air to the first upper zone of the mask and direct exhaust of respirator air from the second lower zone of the mask to the snorkel.

According to various embodiments, a one way circulatory air valve means is disposed in the mask on a side of the separation seal that is distal to the side of the mask to which the snorkel is attached. The circulatory valve means allows air to circulate from the first upper zone of the mask to the second lower zone of the mask when a negative pressure within the second zone of the mask is introduced by inhalation of the user of the full face mask and snorkel. The circulatory valve blocks, however, air from circulating from the second lower zone of the mask to the first upper zone of the mask during positive pressure within the second lower zone of the mask caused by exhalation of respirated air by the user.

The effect of locating the circulation valve on a side of the separation seal that is distal from the side of the full face mask to which the side mount snorkel is attached is a lateral, or side-to-side, circulation means for circulation of fresh surface air over the clear visual lens of the upper zone covering the eyes of the snorkeler thereby increasing evaporation of residual droplets and reducing accumulation of water thereon.

Subject matter disclosed herein can be limited for use partially under water including a snorkel extending to the surface of the water to allow the user to draw air from the atmosphere with no means to supply respiratory gas under positive pressure. One skilled in the art will appreciate that, for this and other processes and methods disclosed herein, the functions performed in the processes and methods may be implemented in differing order. Moreover, the structures of apparatus may be reorganized or variated used to accomplish a given feature or function. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It is understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, quadrants, thirds, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 routes refers to groups having 1, 2, or 3 routes. Similarly, a group having 1-5 impact zones refers to groups having 1, 2, 3, 4, or 5 impact zones and more or less, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims. All references recited herein are incorporated herein by specific reference in their entirety.

What is claimed is:

1. A full face mask and snorkel for use during exploration of aquatic environments comprising:

a full face mask defined by a top, a bottom, a left side, and a right side, including:

a rigid mask support structure defining a shape of the full face mask;

a full face seal coupled to the mask's rigid support structure, the full face seal made of a flexible resilient material for creating a seal between the full face mask and a face of a user when worn by the user; and a separation seal dividing the full face mask into at least an upper chamber sealed from a lower chamber by the separation seal; and a rigid snorkel connectable to the left side or the right side of the full face mask, the rigid snorkel including:

an air intake channel extending along a length of the rigid snorkel for intake of surface air into the upper chamber of the full face mask; and an exhaust channel extending along a length of the rigid snorkel for exhaust of respirated air from the lower chamber of the full face mask, wherein:

the intake and exhaust channels of the snorkel respectively access the upper and lower chambers of the full face mask through an integrated port disposed at a left side or right side of the rigid support structure of the full face mask; and the access of the snorkel to the upper and lower chambers of the full face mask through the integrated port disposed at the left side or right side of the full face mask lacks peripheral ducting around a periphery of the full face mask.

2. A full face mask and snorkel according to claim 1, wherein the integrated port of the rigid support structure of the mask includes a direct inlet for surface air from the intake channel of the snorkel to the upper chamber of the full face mask and a direct outlet for respirated air from the lower chamber of the full face mask to the exhaust channel of the snorkel.

3. A full face mask and snorkel according to claim 1, further comprising an exhalation valve disposed in the snorkel, the exhalation valve providing for single direct flow of respirated air through the exhaust channel of the snorkel and to the surface.

4. A full face mask and snorkel according to claim 3, wherein the exhalation valve is disposed in an end of the snorkel proximate to the full face mask.

5. A full face mask and snorkel according to claim 1, further comprising a circulation valve providing circulation of intake air from the upper chamber to the lower chamber and inhibiting circulation of respirated air from the lower chamber to the upper chamber of the full face mask.

6. A full face mask and snorkel according to claim 5, the circulation valve being disposed on the left side or right side of the full face mask opposite to the snorkel.

7. A full face mask and snorkel according to claim 5, wherein the arrangement of the snorkel and circulation valve promotes side-to-side circulation of intake air in the upper chamber and over a clear optical lens of the full face mask.

8. A full face mask and snorkel according to claim 1, wherein the rigid snorkel is formed integral with the rigid support structure of the full face mask.

9. A full face mask and snorkel according to claim 1, wherein the separation seal divides the upper chamber proximate the top of the full face mask from the lower chamber proximate the bottom of the full face mask.

10. A full face mask and snorkel according to claim 9, wherein the upper chamber is partially defined by a transparent lens covering the eyes of the user when worn by the user.

11. A full face mask and snorkel according to claim 10, wherein the lower chamber creates an under-water air encapsulated respiratory air supply for the user to breathe surface air circulated from the snorkel into the upper chamber, through the separation seal, and to the lower chamber.

12. A full face mask and snorkel according to claim 1, wherein:

the air intake channel of the snorkel supplies surface air through the integrated port and to the left side or right side of the upper chamber of the full face mask, the upper chamber of the full face mask surrounding the eyes of the user when worn by the user; and the exhaust channel of the snorkel receives respirated air through the integrated port from the left side or right side of the lower chamber of the full face mask, intake and exhaust ports of the integrated port being respectively disposed directly above and directly below the separation seal defining the upper chamber from the lower chamber of the full face mask.

13. A full face mask and snorkel according to claim 12, wherein the exhaust channel of the snorkel provides a respiratory exhaust air conduit to the surface air from the lower chamber of the full face mask.

14. A full face mask and snorkel according to claim 12, the separation seal including a separation seal valve, the separation seal valve allowing air to pass through the separation seal under negative pressure to the lower chamber of the full face mask but occluding air from passing through the separation seal under positive pressure in the lower chamber of the full face mask.

15. A full face mask and snorkel according to claim 14, wherein the snorkel is attached to the integrated port located at the left side or right side of the mask proximate to where the separation seal meets a periphery of the mask.

16. A full face mask and snorkel according to claim 1, wherein the snorkel extends at a first length from the left side or the right side of the mask at a first acute angle toward the top of the mask and a second acute angle along a second length, the second acute angle being substantially perpendicular relative to a frame of the mask and extending to a distal end of the snorkel.

17. A full face mask and snorkel according to claim 1, further comprising a float chamber disposed in a float channel of the snorkel, the float chamber located distal from a float seal and being sized and shaped to partially encapsulate a float at the position distal from the float seal so as to inhibit flow of inhaled gas over the float.

18. A full face mask and snorkel according to claim 17, the float chamber further comprising an aperture through a wall of the float chamber allowing water to enter the float chamber upon submersion.

19. A full face mask and snorkel according to claim 1, wherein the integrated port of the rigid support structure includes a direct inlet for surface air from the intake channel of the snorkel to a left side or right side of the upper chamber of the full face mask and a direct outlet for respirated air from a left or right side of the lower chamber of the mask to the exhaust channel of the snorkel.

20. A full face mask and snorkel according to claim 19, wherein the integrated port and rigid support structure are formed integral with the snorkel.

21. A full face mask and snorkel according to claim 1, wherein a direct outlet of the integrated port to the snorkel is devoid of ducting of respirated air to the top of the full face mask.

22. A full face mask and snorkel for use during exploration of aquatic environments comprising:

a full face mask, including:

a rigid mask-support structure defining a shape of the full face mask, the full face mask being defined by a top, bottom, left side, and right side, the rigid support structure including an integrated port disposed at the right side or the left side of the rigid support structure, the integrated port spanning a location where a separation seal meets a full face seal on the side of the full face mask;

the full face seal coupled to the mask's rigid support structure, the full face seal made of a flexible resilient material for creating a seal between the full face mask and a face of a user when worn by the user; and the separation seal dividing the full face mask into at least an upper chamber sealed from a lower chamber by the separation seal;

a rigid snorkel connectable to the integrated port, the rigid snorkel including:

an air intake channel extending along a length of the rigid snorkel for intake of surface air into the upper chamber of the full face mask; and an exhaust channel extending along a length of the rigid snorkel for exhaust of respirated air from the lower chamber of the full face mask, wherein the integrated port of the rigid support structure includes a direct inlet for surface air from the intake channel of the snorkel to the upper chamber of the full face mask and a direct outlet for respirated air from the lower chamber of the mask without peripheral ducting around either side of the full face mask.

23. A full face mask and snorkel according to claim 22, the full face mask and rigid snorkel collectively including means for introducing a horizontal fresh air circulation over an interior side of a visual lens of the full face mask including a deflector for directing intake air away from eyes of the user and toward an interior surface of the visual lens of the full face mask.

24. A full face mask and snorkel for use during exploration of aquatic environments comprising:

a full face mask, including:

a rigid mask support structure defining a shape of the full face mask, the full face mask being defined by a top, bottom, left side, and right side;

a full face seal coupled to the mask's rigid support structure, the full face seal made of a flexible resilient material for creating a seal between the full face mask and a face of a user when worn by the user; and a separation seal dividing the full face mask into at least an upper chamber sealed from a lower chamber by the separation seal; and a rigid snorkel connectable to a side of the full face mask and extending at a first acute angle to a plane defined by a face plate of the mask toward the top of the mask and at a second angle substantially perpendicular to the plane defined by the faceplate of the mask to a distal end of the rigid snorkel, the rigid snorkel including:

an air intake channel extending along a length of the rigid snorkel for intake of surface air into the upper chamber of the full face mask; and an exhaust channel extending along a length of the rigid snorkel for exhaust of respirated air from the lower chamber of the full face mask.

25. A full face mask and snorkel according to claim 24, wherein the rigid snorkel connects to an integrated port of the rigid support structure of the mask that includes a direct inlet for surface air from the intake channel of the snorkel to the upper chamber of the full face mask and a direct outlet for respirated air from the lower chamber of the mask to the exhaust channel of the snorkel.

* * * * *